US008276346B2

(12) United States Patent
Lancaster, III et al.

(10) Patent No.: US 8,276,346 B2
(45) **Date of Patent: *Oct. 2, 2012**

(54) WRAPPING APPARATUS AND METHOD INCLUDING METERED PRE-STRETCH FILM DELIVERY ASSEMBLY

(75) Inventors: Patrick R. Lancaster, III, Louisville, KY (US); David E. Eldrige, Fern Creek, KY (US); Willie M. Hall, Taylorsville, KY (US); Richard L. Johnson, Lagrange, KY (US); Curtis W. Martin, Georgetown, IN (US); Philip R. Moore, Mount Washington, KY (US); Joseph D. Norris, Pleasureville, KY (US)

(73) Assignee: Lantech.com, LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/340,098

(22) Filed: Dec. 29, 2011

(65) Prior Publication Data

US 2012/0124944 A1 May 24, 2012

Related U.S. Application Data

(63) Continuation of application No. 12/861,747, filed on Aug. 23, 2010, now abandoned, which is a continuation of application No. 11/709,871, filed on Feb. 23, 2007, now Pat. No. 7,779,607.

(60) Provisional application No. 60/775,779, filed on Feb. 23, 2006.

(51) Int. Cl.
*B65B 11/02* (2006.01)

(52) U.S. Cl. ..... 53/399; 53/441; 53/66; 53/556; 53/587; 53/588; 53/589

(58) Field of Classification Search ..... 53/397, 53/399, 441, 64, 66, 556, 587–589; *B65B 11/02*
See application file for complete search history.

(56) References Cited

U.S. PATENT DOCUMENTS

| | | | |
|---|---|---|---|
| 2,227,398 | A | 12/1940 | Mohl |
| 3,029,571 | A | 4/1962 | Douthit |
| 3,815,313 | A | 6/1974 | Heisler |
| 4,152,879 | A | 5/1979 | Shulman |
| 4,216,640 | A | 8/1980 | Kaufman |

(Continued)

FOREIGN PATENT DOCUMENTS

DE 3140972 A1 * 6/1982

(Continued)

OTHER PUBLICATIONS

Australian Patent Office; Office Action in Australian Patent Application No. 2007221246 dated Aug. 23, 2011; 2 pages.

(Continued)

*Primary Examiner* — Stephen F Gerrity
(74) *Attorney, Agent, or Firm* — Wood, Herron & Evans, LLP

(57) ABSTRACT

Methods and apparatus for dispensing a predetermined fixed amount of pre-stretched packaging material to a load are disclosed. An amount of pre-stretched packaging material to be dispensed by a packaging material dispenser is determined based upon the girth of the load to be wrapped. Once the amount of packaging material to be dispensed is determined, a ratio of relative rotational speed to packaging material dispenser speed can be set and mechanically controlled. In an alternative embodiment, the ratio is electronically controlled.

41 Claims, 19 Drawing Sheets

U.S. PATENT DOCUMENTS

| | | | |
|---|---|---|---|
| 4,235,062 | A | 11/1980 | Lancaster, III et al. |
| 4,271,657 | A | 6/1981 | Lancaster, III et al. |
| 4,300,326 | A | 11/1981 | Stackhouse |
| 4,387,548 | A | 6/1983 | Lancaster et al. |
| 4,395,255 | A | 7/1983 | Branecky et al. |
| 4,418,510 | A | 12/1983 | Lancaster, III et al. |
| 4,432,185 | A | 2/1984 | Geisinger |
| 4,458,467 | A | 7/1984 | Shulman et al. |
| 4,501,105 | A | 2/1985 | Rogers et al. |
| 4,503,658 | A | 3/1985 | Mouser et al. |
| 4,505,092 | A | 3/1985 | Bowers et al. |
| 4,514,955 | A | 5/1985 | Mouser et al. |
| 4,590,746 | A | 5/1986 | Humphrey |
| 4,676,048 | A | 6/1987 | Lancaster et al. |
| 4,693,049 | A | 9/1987 | Humphrey |
| 4,712,354 | A | 12/1987 | Lancaster et al. |
| 4,754,594 | A | 7/1988 | Lancaster |
| 4,761,934 | A | 8/1988 | Lancaster |
| 4,807,427 | A | 2/1989 | Casteel et al. |
| 4,840,006 | A | 6/1989 | Humphrey |
| 4,845,920 | A | 7/1989 | Lancaster |
| 4,905,451 | A | 3/1990 | Jaconelli et al. |
| 4,953,336 | A | 9/1990 | Lancaster, III et al. |
| 4,991,381 | A | 2/1991 | Simons |
| 5,040,356 | A | 8/1991 | Thimon |
| 5,040,359 | A | 8/1991 | Thimon |
| 5,077,956 | A | 1/1992 | Thimon |
| 5,107,657 | A | 4/1992 | Diehl et al. |
| 5,123,230 | A | 6/1992 | Upmann |
| 5,138,817 | A | 8/1992 | Mowry et al. |
| 5,186,981 | A | 2/1993 | Shellhamer et al. |
| 5,195,296 | A | 3/1993 | Matsumoto |
| 5,195,297 | A | 3/1993 | Lancaster et al. |
| 5,195,301 | A | 3/1993 | Martin-Cocher et al. |
| 5,203,136 | A | 4/1993 | Thimon et al. |
| 5,203,139 | A | 4/1993 | Salsburg et al. |
| 5,216,871 | A | 6/1993 | Hannen |
| 5,240,198 | A | 8/1993 | Dorfel |
| 5,301,493 | A | 4/1994 | Chen |
| 5,311,725 | A | 5/1994 | Martin et al. |
| 5,414,979 | A | 5/1995 | Moore et al. |
| 5,447,008 | A | 9/1995 | Martin-Cocher |
| 5,450,711 | A | 9/1995 | Martin-Cocher |
| 5,463,842 | A | 11/1995 | Lancaster |
| 5,572,855 | A | 11/1996 | Reigrut et al. |
| 5,595,042 | A | 1/1997 | Cappi et al. |
| 5,653,093 | A | 8/1997 | Delledonne |
| 5,671,593 | A | 9/1997 | Ginestra et al. |
| 5,765,344 | A | 6/1998 | Mandeville et al. |
| 5,799,471 | A | 9/1998 | Chen |
| 5,836,140 | A | 11/1998 | Lancaster, III |
| 5,875,617 | A | 3/1999 | Scherer |
| 5,884,453 | A | 3/1999 | Ramsey et al. |
| 5,953,888 | A | 9/1999 | Martin-Cocher et al. |
| 6,082,081 | A | 7/2000 | Mucha |
| 6,195,968 | B1 | 3/2001 | Marois et al. |
| 6,253,532 | B1 | 7/2001 | Orpen |
| 6,293,074 | B1 | 9/2001 | Lancaster, III et al. |
| 6,360,512 | B1 | 3/2002 | Marois et al. |
| 6,370,839 | B1 * | 4/2002 | Nakagawa et al. ..... 53/64 |
| 6,453,643 | B1 | 9/2002 | Buscherini et al. |
| 6,698,161 | B1 | 3/2004 | Rossi |
| 6,748,718 | B2 | 6/2004 | Lancaster, III et al. |
| 6,826,893 | B2 | 12/2004 | Cere' |
| 6,851,252 | B2 | 2/2005 | Maki-Rahkola et al. |
| 6,918,229 | B2 | 7/2005 | Lancaster, III et al. |
| 7,386,968 | B2 | 6/2008 | Sperry et al. |
| 7,779,607 | B2 | 8/2010 | Lancaster, III et al. |
| 2001/0015057 | A1 * | 8/2001 | Suolahti ..... 53/556 |
| 2003/0110737 | A1 | 6/2003 | Lancaster et al. |
| 2003/0145563 | A1 | 8/2003 | Cere' |
| 2003/0200732 | A1 | 10/2003 | Maki-Rahkola et al. |
| 2004/0031238 | A1 | 2/2004 | Cox |
| 2005/0044812 | A1 | 3/2005 | Lancaster et al. |
| 2005/0115202 | A1 | 6/2005 | Mertz et al. |
| 2006/0213155 | A1 | 9/2006 | Forni et al. |
| 2006/0248858 | A1 | 11/2006 | Lancaster |
| 2006/0254225 | A1 | 11/2006 | Lancaster et al. |
| 2006/0289691 | A1 | 12/2006 | Forni |
| 2007/0204565 | A1 | 9/2007 | Lancaster et al. |
| 2007/0209324 | A1 | 9/2007 | Lancaster et al. |

FOREIGN PATENT DOCUMENTS

| | | | | |
|---|---|---|---|---|
| DE | 3634924 | A1 | | 4/1988 |
| DE | 4234604 | A1 | | 4/1994 |
| EP | 0096635 | A2 | | 12/1983 |
| EP | 246659 | A1 | * | 11/1987 |
| EP | 0466980 | A1 | | 1/1992 |
| EP | 0811554 | A1 | | 12/1997 |
| EP | 1213223 | A1 | | 6/2002 |
| EP | 1705119 | A1 | | 9/2006 |
| EP | 1717149 | A1 | | 11/2006 |
| EP | 1736426 | A2 | | 12/2006 |
| GB | 2107668 | A | | 5/1983 |
| JP | 11165705 | A | * | 6/1999 |
| JP | 2001-072012 | | | 3/2001 |
| JP | 2004-161344 | | | 6/2004 |
| WO | 9822346 | A1 | | 5/1998 |
| WO | 2004069659 | A1 | | 8/2004 |
| WO | 2006110596 | A1 | | 10/2006 |
| WO | 2007071593 | A1 | | 6/2007 |
| WO | 2007100597 | A2 | | 9/2007 |
| WO | 2008007189 | A2 | | 1/2008 |

OTHER PUBLICATIONS

Canadian Patent Office; Office Action in Canadian Patent Application No. 2,643,309 dated Dec. 29, 2011; 3 pages.

European Patent Office; Office Action in European Patent Application No. 07751358.8 dated Mar. 15, 2012; 7 pages.

Japanese Patent Office; Office Action in Japanese Patent Application No. 2008-556417 dated Mar. 13, 2012; 5 pages.

* cited by examiner

WRAPPING APPARATUS AND METHOD INCLUDING METERED PRE-STRETCH FILM DELIVERY ASSEMBLY

This application is a continuation of U.S. patent application Ser. No. 12/861,747, filed Aug. 23, 2010, now abandoned, which is a continuation of U.S. patent application Ser. No. 11/709,871, filed Feb. 23, 2007, (now U.S. Pat. No. 7,779,607 issued Aug. 24, 2010) which claims priority to U.S. Provisional Application Ser. No. 60/775,779, filed Feb. 23, 2006, the complete disclosures of which are incorporated herein by reference.

TECHNICAL FIELD

The present disclosure relates to an apparatus and a method for wrapping a load with packaging material, and more particularly, stretch wrapping.

BACKGROUND

Various packaging techniques have been used to build a load of unit products and subsequently wrap them for transportation, storage, containment and stabilization, protection and waterproofing. One system uses stretch wrapping machines to stretch, dispense and wrap stretch packaging material around a load. Stretch wrapping can be performed as an inline, automated packaging technique that dispenses and wraps packaging material in a stretch condition around a load on a pallet to cover and contain the load. Pallet stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

Stretch wrapping machines provide relative rotation between a stretch wrap packaging dispenser and a load either by driving the stretch wrap packaging dispenser around a stationary load or rotating the load on a turntable. Upon relative rotation, packaging material is wrapped on the load. Rotating ring style stretch wrappers generally include a roll of packaging material mounted in a dispenser, which rotates about the load on a rotating ring. Wrapping rotating rings are categorized as vertical rotating rings or horizontal rotating rings. Vertical rotating rings move vertically between an upper and lower position to wrap packaging material around a load. In a vertical rotating ring, as in turntable and rotating wrap arm apparatuses, the four vertical sides of the load are wrapped, along the height of the load. Horizontal rotating rings are stationary and the load moves through the rotating ring, usually on a conveyor, as the packaging material dispenser rotates around the load to wrap packaging material around the load. In the horizontal rotating ring, the length of the load is wrapped. As the load moves through the rotating ring and off the conveyor, the packaging material slides off the conveyor (surface supporting the load) and into contact with the load.

Historically, rotating ring style wrappers have suffered from excessive packaging material breaks and limitations on the amount of containment force applied to the load (as determined in part by the amount of pre-stretch used) due to erratic speed changes required to wrap "non-square" loads, such as narrow, tall loads, short, wide loads, and short, narrow loads. The non-square shape of such loads often results in the supply of excess packaging material during the wrapping cycle, during time periods in which the demand rate for packaging material by the load is exceeded by the supply rate of the packaging material by the packaging material dispenser. This leads to loosely wrapped loads. In addition, when the demand rate for packaging material by the load is greater than the supply rate of the packaging material by the packaging material dispenser, breakage of the packaging material may occur.

When stretch wrapping a typical rectangular load, the demand for packaging material varies, decreasing as the packaging material approaches contact with a corner of the load and increasing after contact with the corner of the load. When wrapping a tall, narrow load or a short load, the variation in the demand rate is even greater than in a typical rectangular load. In vertical rotating rings, high speed rotating arms, and turntable apparatuses, the variation is caused by a difference between the length and the width of the load. In a horizontal rotating ring apparatus, the variation is caused by a difference between the height of the load (distance above the conveyor) and the width of the load.

The amount of force, or pull, that the packaging material exhibits on the load determines how tightly and securely the load is wrapped. Conventionally, this force is controlled by controlling the feed or supply rate of the packaging material dispensed by the packaging material dispenser with respect to the demand rate of packaging material required by the load. Efforts have been made to supply the packaging material at a constant tension or at a supply rate that increases as the demand rate increases and decreases as the demand rate decreases. However, when variations in the demand rate are large, fluctuations between the feed and demand rates result in loose packaging of the load or breakage of the packaging material during wrapping.

The wrap force of many known commercially available pallet stretch wrapping machines is controlled by sensing changes in demand and attempting to alter supply of packaging material such that relative constant packaging material wrap force is maintained. With the invention of powered pre-stretching devices, sensing force and speed changes was immediately recognized to be critically important. This has been accomplished using feedback mechanisms typically linked to or spring loaded dancer bars and electronic load cells. The changing force on the packaging material caused by rotating a rectangular shaped load is transmitted back through the packaging material to some type of sensing device which attempts to vary the speed of the motor driven pre-stretch dispenser to minimize the force change on the packaging material incurred by the changing packaging material demand. The passage of the corner causes the force on the packaging material to increase. This increase force is typically transmitted back to an electronic load cell, spring-loaded dancer interconnected with a sensing means, or by speed change to a torque control device. After the corner is passed the force on the packaging material reduces as the packaging material demand decreases. This force or speed is transmitted back to some device that in turn reduces the packaging material supply to attempt to maintain a relatively constant wrap force.

With the ever faster wrapping rates demanded by the industry, the rotation speeds have increased significantly to a point where the concept of sensing demand change and altering supply speed is no longer effective. The delay of response has been observed to begin to move out of phase with rotation at approximately 20 RPM. The actual response time for the rotating mass of packaging material roll and rollers approximating 100 lbs must shift from accelerate to decelerate eight times per revolution that at 20 RPM is a shift more than every ½ sec.

Even more significant is the need to minimize the acceleration and deceleration times for these faster cycles. Initial acceleration must pull against the clamped packaging material, which typically cannot stand a high force especially the high force of rapid acceleration that cannot be maintained by the feedback mechanisms described above. Use of high speed wrapping has therefore been limited to relatively lower wrap forces and pre-stretch levels where the loss of control at high speeds does not produce undesirable packaging material breaks.

Packaging material dispensers mounted on horizontally rotating rings present additional special issues concerning effectively wrapping at high speeds. Many commercially available rotating ring wrappers that are in use depend upon electrically powered motors to drive the pre-stretch packaging material dispensers. The power for these motors must be transmitted to the rotating ring. This is typically done through electric slip rotating rings mounted to the rotating ring with an electrical pick up fingers mounted to the fixed frame. Alternately others have attempted to charge a battery or run a generator during rotation. All of these devices suffer complexity, cost and maintenance issues. But even more importantly they add significant weight to the rotating ring which impacts its ability to accelerate and/or decelerate rapidly.

Packaging material dispensers mounted on vertically rotating rings have the additional problem of gravity forces added to centrifugal forces of high-speed rotation. High-speed wrappers have therefore required expensive and very heavy two part bearings to support the packaging material dispensers. The presence of the outer race on these bearings has made it possible to provide a belt drive to the pre-stretch dispenser. This drive is taken through a clutch type torque device to deliver the variable demand rate required for wrap force desired.

Accordingly, it is an object of the present disclosure to provide a method and apparatus for regulating the feed of packaging material to produce a secure load for shipment without distorting the top layers of a load, crushing product, or breaking film.

It is another object of the present disclosure to provide a method and apparatus capable of regulating the packaging material supply rate to maintain a wrapping force below the force that will incur film breaks.

It is an additional object of the present disclosure to provide a method and apparatus for wrapping loads at faster wrapping rates.

It is an additional object of the present disclosure to provide a method and apparatus capable of minimizing packaging material dispenser acceleration and deceleration times, in order to obtain faster wrapping cycles.

It is an additional object of the present disclosure to provide a method and apparatus that reduces the amount of complexity, cost, weight, and maintenance associated with known rotating ring apparatuses.

SUMMARY

In accordance with the present disclosure, a method and apparatus for dispensing a length of pre-stretched packaging material relative to load girth is provided. The method and apparatus include a linkage between a rotational drive system for providing relative rotation between a load and a packaging material dispenser and a pre-stretch assembly portion of the packaging material dispenser. The linkage may be mechanical or electrical. The linkage controls a ratio of the rotational speed to the pre-stretch assembly dispensing speed, such that the length of pre-stretched packaging material is dispensed for each revolution of the packaging material dispenser relative to the load regardless of the speed of the rotational drive. In the case of a mechanical linkage, the linkage also connects the rotational drive to the pre-stretch assembly portion such that the rotational drive also drives the pre-stretch assembly portion.

According to one aspect of the present disclosure, an apparatus for stretch wrapping a load is provided. The apparatus includes a rotatable ring, a packaging material dispenser for dispensing a film web, the packaging material dispenser being mounted on the rotatable ring and including an upstream pre-stretch roller and a downstream pre-stretch roller within a pre-stretch assembly, a drive mechanism configured to rotate the rotatable ring, an input/output ratio control configured to maintain a ratio of ring rotation speed to pre-stretch speed during at least a primary portion of a wrapping cycle, and a final roller positioned a distance from the downstream pre-stretch roller, the distance being such that at least a portion of a length of film extending between the downstream pre-stretch roller and the final roller acts to dampen variations in forces acting on the pre-stretched packaging material as it travels from the dispenser to the load.

According to another aspect of the present disclosure, an apparatus for stretch wrapping a load comprises a rotatable ring, a packaging material dispenser for dispensing a film web, the packaging material dispenser being mounted on the rotatable ring and including a pre-stretch assembly, a drive mechanism configured to rotate the rotatable ring, an input/output ratio control configured to maintain a ratio of ring rotation speed to pre-stretch speed during at least a primary portion of a wrapping cycle, and a virtual film accumulator configured to accommodate variations in film demand as the film is dispensed.

According to a further aspect of the present disclosure, an apparatus for stretch wrapping a load includes a rotatable ring, a packaging material dispenser for dispensing a film web, the packaging material dispenser including a pre-stretch assembly, a drive mechanism configured to rotate the rotatable ring, and a mechanical input/output ratio control to set a ratio of relative rotation speed to pre-stretch speed, an output of the mechanical input/output ratio control driving the pre-stretch assembly to dispense a length of pre-stretched packaging material for at least a portion of a revolution of the relative rotation between the load and the packaging material dispenser.

According to yet another aspect of the present disclosure, a method for stretch wrapping a load is provided. The method comprises providing a packaging material dispenser mounted on a rotatable ring, the packaging material dispenser including a pre-stretch portion, rotating the rotatable ring and the packaging material dispenser around the load, setting a ratio of rotational speed to pre-stretch speed with an input/output ratio control, and driving the pre-stretch assembly to dispense a length of pre-stretched packaging material during at least a portion of a revolution of the relative rotation between the load and the packaging material dispenser.

According to one aspect of the present disclosure, a method for stretch wrapping a load includes determining a girth of a load to be wrapped, determining a length of pre-stretched packaging material to be dispensed for at least a portion of a revolution of a packaging material dispenser around the load based, rotating a rotatable ring to rotate the packaging material dispenser around the load, setting a ratio of relative rotational speed to pre-stretch speed, and driving the pre-stretch portion at the set ratio through a mechanical connection to the rotational drive to dispense the length of pre-stretched packaging material during the at least a portion of a revolution of the relative rotation between the load and the packaging material dispenser.

According to another aspect of the present disclosure, a method for stretch wrapping a load comprises providing a packaging material dispenser mounted on a rotatable ring, the packaging material dispenser including a pre-stretch portion, rotating the rotatable ring and the packaging material dispenser around the load, setting a ratio of rotational speed to pre-stretch speed with an input/output ratio control, driving the pre-stretch assembly to dispense a length of pre-stretched film during at least a portion of a revolution of the relative rotation between the load and the packaging material dispenser, moving the rotating ring vertically relative to the load, and roping a portion of the film into a rolled cable of film as the rotating ring moves vertically with respect to the load so as to wrap the rolled cable of film spirally around the load.

According to a further aspect of the present disclosure, an apparatus for stretch wrapping a load comprises a packaging material dispenser for dispensing a film web, the packaging material dispenser including a powered pre-stretch portion, a rotatable ring, a rotational drive for rotating the ring and the dispenser around the load during the wrapping cycle, and an electronic control configured to maintain a ratio between a drive powering the pre-stretch portion and the rotational drive during a primary portion of a wrap cycle.

According to yet another aspect of the present disclosure, an apparatus for stretch wrapping a load comprises a rotatable ring, a packaging material dispenser for dispensing a film web mounted on the rotatable ring, the packaging material dispenser including an upstream pre-stretch roller and a downstream pre-stretch roller within a powered pre-stretch assembly, a rotational drive system for rotating the ring during the wrapping cycle, an electronic control configured to maintain a ratio between a drive powering the pre-stretch portion and the rotational drive system during a primary portion of a wrap cycle, and a film drive down roller positioned to continuously engage at least a portion of a width of the film web in a film path from the dispenser to the load, the film drive down roller being selectively moveable between a vertical position and a tilted film drive down position.

According to one aspect of the present disclosure, an apparatus for stretch wrapping a load comprises a rotatable ring, a packaging material dispenser for dispensing a film web, the packaging material dispenser mounted on the rotatable ring and including a powered pre-stretch portion, a rotational drive for rotating the ring during the wrapping cycle, a film drive down roller positioned to continuously engage at least a portion of a width of the film web in a film path from the dispenser to the load, the film drive down roller being selectively moveable between a vertical position and a tilted film drive down position, and a virtual film accumulator configured to accommodate variations in film demand as the film is dispensed.

According to another aspect of the present disclosure, a method for stretch wrapping a load comprises providing a packaging material dispenser mounted on a rotatable ring, the packaging material dispenser including a powered pre-stretch portion, rotating the ring and the packaging material dispenser around the load, setting a ratio of relative rotational speed to pre-stretch speed, electronically maintaining the set ratio during a primary portion of the wrap cycle to dispense pre-stretched packaging material, and electronically varying the set ratio during at least one of an initial acceleration and a final deceleration of the packaging material dispenser relative to the load.

According to a further aspect of a present disclosure, a method for stretch wrapping a load comprises providing a rotatable ring with a packaging material dispenser mounted thereon, rotating the ring and the packaging material dispenser around the load, setting a ratio of relative rotational speed to pre-stretch speed, electronically maintaining the set ratio during a primary portion of the wrap cycle to dispense a length of pre-stretched packaging material during at least a portion of a revolution of the packaging material dispenser relative to the load during the primary portion of the wrap cycle, electronically varying the set ratio upon sensing at least one of a film break and slack film, and damping variations in forces acting on the dispensed length of pre-stretched packaging material as it travels from the dispenser to the load.

According to yet another aspect of a present disclosure, a method for wrapping a load with a film web is provided. The method includes providing a film web dispenser mounted on a rotatable ring, rotating the ring to provide relative rotation between the load and a film web dispenser to wrap the film web on the load, positioning a first clamping element adjacent to the load during a wrapping cycle, overwrapping the first clamping element with the film web, positioning a second clamping element adjacent to the first clamping element such that the film web is clamped between the first and second clamping elements, simultaneously cutting the film web as the film web is clamped between the first and second clamping elements to form a leading end and a trailing end of film, and pressing the trailing end of film against the load.

According to one aspect of a present disclosure, a method for wrapping a load with a film web includes clamping a leading end of the web between extended first and second clamping elements, rotating a ring supporting a film web dispenser around the load to wrap the film web on the load, retracting the first and second clamping elements after one revolution of a wrapping cycle, positioning the first clamping element adjacent to the load after a number of revolutions of the wrapping cycle, overwrapping the first clamping element with the film web, positioning a second clamping element adjacent to the first clamping element such that the film web is clamped between the first and second clamping elements, simultaneously cutting the film web as the film web is clamped between the first and second clamping elements to form a leading end and a trailing end of film, and pressing the trailing end of film against the load.

Additional objects and advantages of the disclosure will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate one embodiment of the disclosure and together with the description, serve to explain the principles of the disclosure.

DETAILED DESCRIPTION

Figure 1:
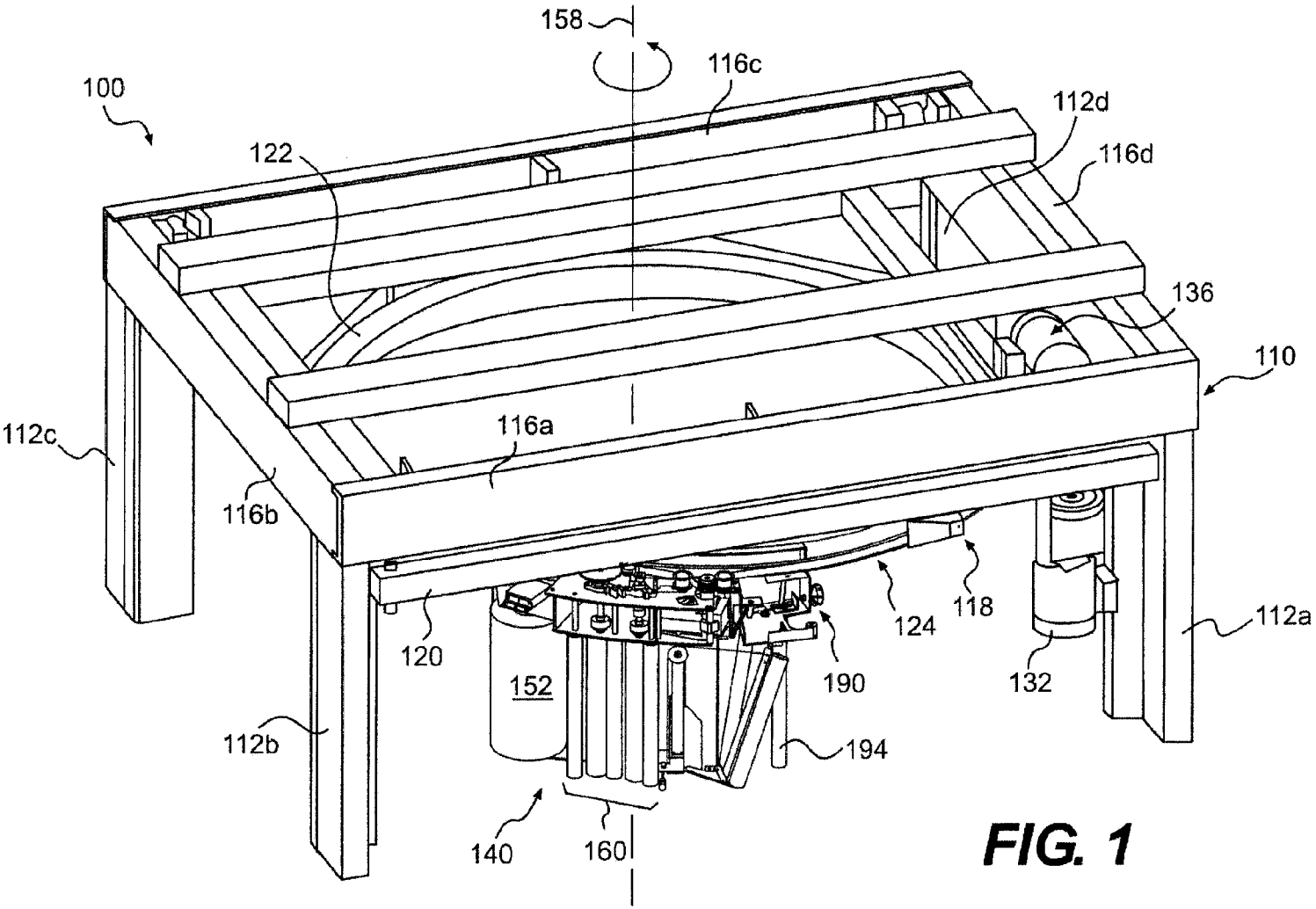
FIG. 1 is an isometric view of a stretch wrapping apparatus for wrapping a load according to one aspect of the present disclosure.

Reference will now be made in detail to the present embodiment of the disclosure, an example of which is illustrated in the accompanying drawings. Examples and descriptions of the disclosure are also set forth in the Invention Disclosure that is included as part of the provisional application and incorporated herein by reference. In addition, the disclosures of each of U.S. Pat. No. 4,418,510, U.S. Pat. No. 4,953,336, U.S. Pat. No. 4,503,658, U.S. Pat. No. 4,676,048, U.S. Pat. No. 4,514,955, and U.S. Pat. No. 6,748,718 are incorporated herein by reference in their entirety. In addition, U.S. patent application Ser. No. 11/398,760, filed Apr. 6, 2006, and entitled "Method and Apparatus for Dispensing a Predetermined substantially constant length of Pre-stretched Film Relative to Load Girth," and U.S. patent application Ser. No. 10/767,863, filed Jan. 30, 2004, and entitled "Method and Apparatus for Rolling a Portion of a Film Web into a Cable" are incorporated by herein by reference in their entirety. Wherever possible, the same reference numbers will be used throughout the drawings to refer to the same or like parts.

The present disclosure is related to a method and apparatus for dispensing a predetermined substantially constant length of pre-stretched packaging material per revolution of a packaging material dispenser around a load during a wrapping cycle. The packaging material dispenser may include a pre-stretch portion and a pre-stretch metering assembly. The packaging material dispenser may be rotated about the load to be wrapped, or the load may be rotated relative to the packaging material dispenser. In each case, a rotational drive system is used to provide the relative rotation. The rotational drive system may include a rotating ring (vertical or horizontal), a turntable, or a rotatable arm. A mechanical linkage may be used to connect the rotational drive system to the pre-stretch portion of the packaging material dispenser to drive the pre-stretch portion. Thus, rotation of the downstream roller of the pre-stretch portion of the packaging material assembly is mechanically linked to the rotational drive, ensuring that a ratio of relative rotational speed to pre-stretch speed may be set such that the pre-stretch portion dispenses a substantially constant length of pre-stretched packaging material during each revolution.

The substantially constant length of pre-stretched packaging material dispensed per revolution of the packaging material dispenser is predetermined based upon the girth of the load to be wrapped. The girth (G) of a load is defined as the length (L) of the load plus the width (W) of the load times two (2) or $G=[2\times(L+W)]$. Test results have shown that good wrapping performance in terms of load containment (wrap force) and optimum packaging material use (efficiency) is obtained by dispensing a length of pre-stretched packaging material that is between approximately 90% and approximately 130% of load girth, and preferably between approximately 95% and approximately 115% of load girth. The amount of film dispensed divided by the girth of the load is referred to in this application as the payout percentage. For example, a 40 inch× 48 inch load has a girth of (2×(40+48) or 176 inches. To provide a payout percentage of between approximately 95% and approximately 115%, it would be necessary to dispense a length of pre-stretched packaging material that has a length of between approximately 167 inches and approximately 202 inches. Additional testing has shown that a payout percentage equal to approximately 107% of load girth gives best containment and efficiency results. Thus, for the example above, the predetermined amount of pre-stretched packaging material to be dispensed for each revolution of the packaging material dispenser would be approximately 188 inches. However, the optimum payout percentage will vary according to the type of stretch wrap packaging material used, the level of pre-stretch used (i.e., percentage of elongation), and different load containment (i.e., wrap force) required.

Because a ratio of the relative rotational speed to pre-stretch speed is set and maintained during the wrap cycle, the same amount of pre-stretched packaging material will be dispensed during each revolution of the dispenser relative to the load, regardless of the speed of relative rotation. For example, if approximately 190 inches of packaging material are needed per revolution of the rotating ring/dispenser, one can measure the circumference of the downstream pre-stretch roller, for example 10 inches, and know that each rotation of the downstream pre-stretch roller will dispense 10 inches of pre-stretched packaging material. Therefore, in order to dispense 190 inches of packaging material during one revolution of the rotating ring and dispenser, the downstream pre-stretch roller may rotate 19 times (190 inches/10 inches). Once the necessary number of revolutions of the downstream pre-stretch roller is known, it is possible to set the sprocket to, for example, 19 pre-stretch roller revolutions per one rotating ring rotation. Thus, the length of the pre-stretched packaging material that is dispensed may be between approximately 90% and approximately 120% of girth per rotating ring revolution and the dispensing is mechanically controlled and precisely selectable by establishing a mechanical ratio of a rotational drive (e.g., drive to rotate a rotatable ring, a turntable, or a rotating arm) to pre-stretch roller surface speed (e.g., number of pre-stretch roller revolutions per rotating ring rotation).

Drive components can be arranged for easy change of the amount of pre-stretch of the packaging material or the payout percentage dispensed per revolution of the rotatable ring. For example, in one exemplary embodiment, the packaging material dispenser is mounted on the rotatable ring, and a motor rotates a belt that rotatably drives the rotatable ring. A first portion of a mechanical connection can translate the drive of the motor and rotating belt to drive pre-stretch rollers in the pre-stretch assembly of the packaging material dispenser. A second portion of the mechanical connection controls an input to output ratio so as to set a ratio of the speed of the rotation of the rotatable ring to the speed of the rotation of the pre-stretch rollers in order to obtain the predetermined substantially constant length of film per revolution of the rotatable ring. No electrical slip rings, motor, control box, or force controls are required because the rotation of the rotatable ring drives the pre-stretch rollers through the mechanical connection.

The dispensing of the predetermined substantially constant length of pre-stretched packaging material per revolution of the packaging material dispenser relative to the load may be independent of the speed of the relative rotation. It is independent of the speed of the relative rotation because a ratio of the relative rotational speed to pre-stretch speed is set and mechanically maintained during the wrap cycle. Thus, regardless of the speed of the relative rotation, the ratio is maintained and thus the pre-stretch speed changes accordingly with the relative rotation speed. The dispensing of the predetermined substantially constant length of pre-stretched packaging material per revolution of the packaging material dispenser relative to the load may also be independent of load girth shape or placement of the load. That is, for each revolution of the packaging material dispenser relative to the load, regardless of the speed of the relative rotation, the pre-stretch roller may complete a fixed number of revolutions. If the speed of the relative rotation increases, the amount of time it takes for the pre-stretch roller to complete the fixed number of revolutions may decrease, but the same fixed number of revolutions will be complete during one revolution of the packaging material dispenser relative to the load. Similarly, if the speed of the relative rotation decreases, the amount of time required for the downstream pre-stretch roller to complete the fixed number of revolutions may increase, but the same fixed number of revolutions may be complete during one revolution of the packaging material dispenser relative to the load. Because the speed of the relative rotation is tied to the speed of the pre-stretch through the mechanical link, the proportion or ratio of the speeds is constant, regardless of what those speeds may be. Thus, during acceleration and deceleration of the relative rotation, the pre-stretch assembly accelerates and decelerates with the rotational drive system.

The ability of the rotational drive system and the pre-stretch assembly to accelerate and decelerate together is a particular advantage when a rotatable ring is the means of providing relative rotation. The rotatable ring may be powered for very rapid acceleration to over 60 rpm with an acceleration period of one second and a deceleration period of one second. Since the packaging material feed (via the pre-stretch assembly) may be independent of the relative rotational speed as described above, there is no extra force on the packaging material during acceleration or excess packaging material during deceleration.

If a reduced force below optimum wrapping force is required during initial startup, the rotating ring can be reversed to create slack packaging material at the end of the previous cycle. A one-way clutch may be included to prevent any backlash from packaging material feed while the rotating ring is reversed. The slack packaging material may remain well around the first corner of the load until the elasticity of the dispensed packaging material can take it up.

According to one aspect of the disclosure, a film break sensing roller is provided. The primary purpose of the film break sensing roller is to completely stop film feed as quickly as possible when the film breaks so that the film does not backlash and wind up on the rollers. The film break sensing roller is connected to the mechanical connection which controls the input/output ratio of the speed of the rotational drive to the surface speed of the pre-stretch roller. The film break sensing roller has the ability to shift this ratio such that even though an input is received, the output is zero, effectively stopping the dispensing of film. A secondary purpose of the film break sensing roller is that it senses slack film. As the film break sensing roller moves toward a neutral position, the input/output ratio decreases, slowing the film feed. As the film feed slows and the rotatable ring continues to rotate, the slack is taken up and a new film feed position and input/output ratio are established.

According to one aspect of the present disclosure, a stretch wrapping apparatus 100 for wrapping a load may include a non-rotating frame, a moveable frame, a rotatable ring, a fixed ring, a rotational drive system, and a packaging material dispenser with a pre-stretch assembly.

As embodied herein and shown in FIG. 1, the apparatus 100 may include the non-rotating frame 110. The non-rotating frame 110 may include four vertical legs, 112*a*, 112*b*, 112*c*, and 112*d*. The legs 112*a*, 112*b*, 112*c*, and 112*d* of the non-rotating frame 110 may or may not be positioned over a conveyor (not shown) such that a load 138 to be wrapped may be conveyed into a wrapping space (defined in part by the non-rotating frame 110), wrapped, and then conveyed away from the wrapping space. The non-rotating frame 110 may also include a plurality of horizontal supports 116*a*, 116*b*, 116*c*, 116*d*, that connect the vertical legs 112*a*, 112*b*, 112*c*, and 112*d*, to each other, forming a square or rectangular shape (see FIG. 1). Additional supports may be placed across the square or rectangle formed by the horizontal supports 116*a*, 116*b*, 116*c*, 116*d* (see FIG. 1). In one exemplary embodiment, the non-rotating frame 110 may have a footprint of 88 inches by 100 inches. The benefit of this particular footprint is that it may allow the stretch wrapping apparatus 100 to fit into an enclosed truck for shipment. Prior art devices may generally have a much larger footprint. Due to their large size, disassembly may be required to transport the prior art devices. Otherwise, shipment on a flatbed may be required. Either of those two scenarios could significantly increase shipping costs.

Figure 6:
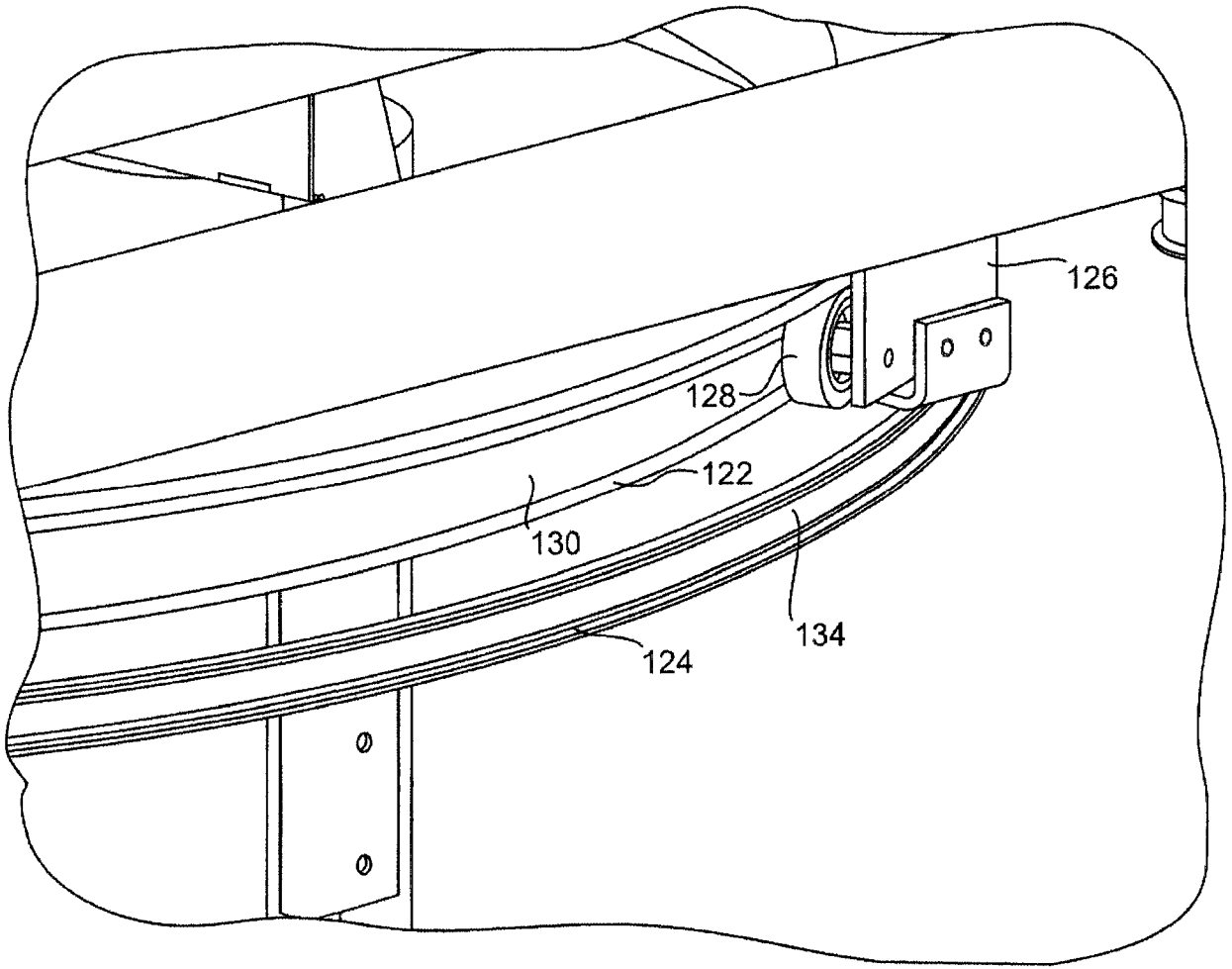
FIG. 6 is an isometric view of a support structure for the rotating ring of a stretch wrapping apparatus according to one aspect of the present disclosure.

A vertically movable frame portion 118 may be connected to and movable on the non-rotating frame 110. As embodied herein and shown in. FIGS. 1, 2, 3A, and 3B, the vertically movable frame portion 118 may include a support portion 120, a rotatable ring 122, and a fixed (i.e., non-rotatable) ring 124. A plurality of rotatable ring supports 126 (see FIG. 6) may extend downwardly from the support portion 120. Each rotatable ring support 126 may have an L-shape and may comprise one or more pieces of material, such as steel, to form the L-shape. It is possible that the rotatable ring supports 126 may have a shape other than an L-shape. Connected to each rotatable ring support 126 may be a roller or wheel 128. Rotatable ring 122 may rest on top of the rollers 128, such that rotatable ring 122 may ride on the rollers 128. Preferably, rotatable ring 122 may be constructed of a very lightweight material. The lightweight nature of the rotatable ring 122 may allow for faster movement of the rotatable ring 122, and thus, faster wrapping cycles. In one exemplary embodiment, the rotatable ring 122 may have an inner diameter of 80 inches, an outer diameter of 88 inches, and may be made of a lightweight composite material. Use of a composite material may reduce the weight of the rotatable ring by approximately 75% when compared to conventional steel or aluminum rotatable rings.

Independent of the rotatable ring 122, the fixed ring 124 may be positioned below and outside of the rotatable ring 122. Fixed ring 124 may be supported by the support portion 120. A first drive belt 130, driven by a motor 132, may be positioned around an outer circumference of the rotatable ring 122. The motor 132 rotates the first drive belt 130 which in turn rotates the rotatable ring 122. Thus, the motor 132 and the first drive belt 130 form a rotational drive system. A second drive belt 134 may be positioned around the outer circumference of the fixed ring 124. The second drive belt is a fixed belt that does not rotate. This second drive belt 134 may be used as part of a mechanical connection between the rotational drive system of the rotatable ring 122 and a pre-stretch assembly of a packaging material dispenser, as will be discussed below. It is also contemplated that a second motor 136 may be provided to raise and/or lower the movable frame portion 118 on non-rotating frame 110. Alternatively, the rotatable ring 122 can be frictionally driven by suitably surfaced wheel(s) pressed against the outer surface of the rotatable ring 122.

Figure 2:
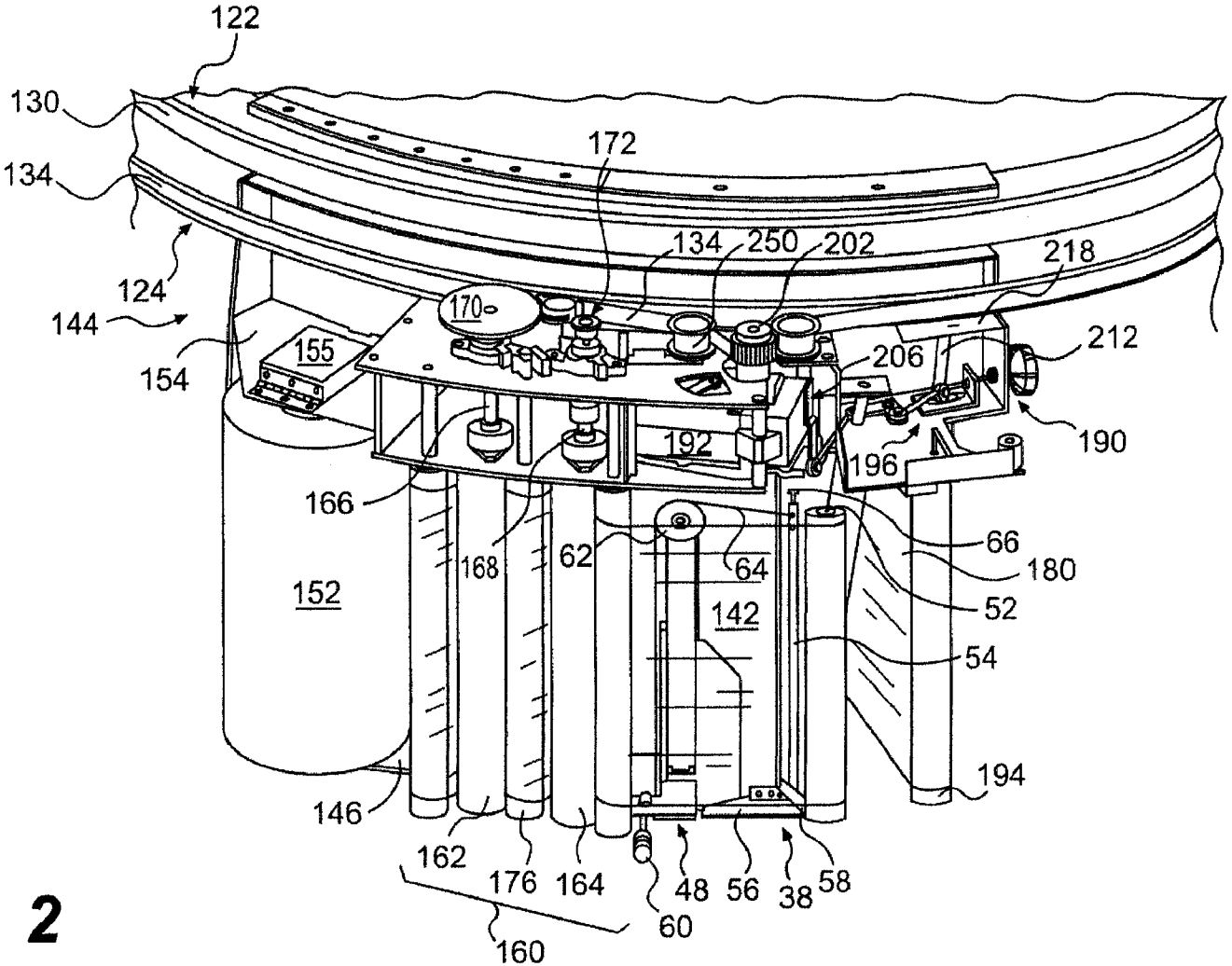
FIG. 2 is an isometric view of a roll carriage of the stretch wrapping apparatus of FIG. 1, the roll carriage including a packaging material dispenser with a pre-stretch portion, a film drive down portion, a virtual accumulator, and a film metering portion, according to one aspect of the present disclosure.
Figure 3A:
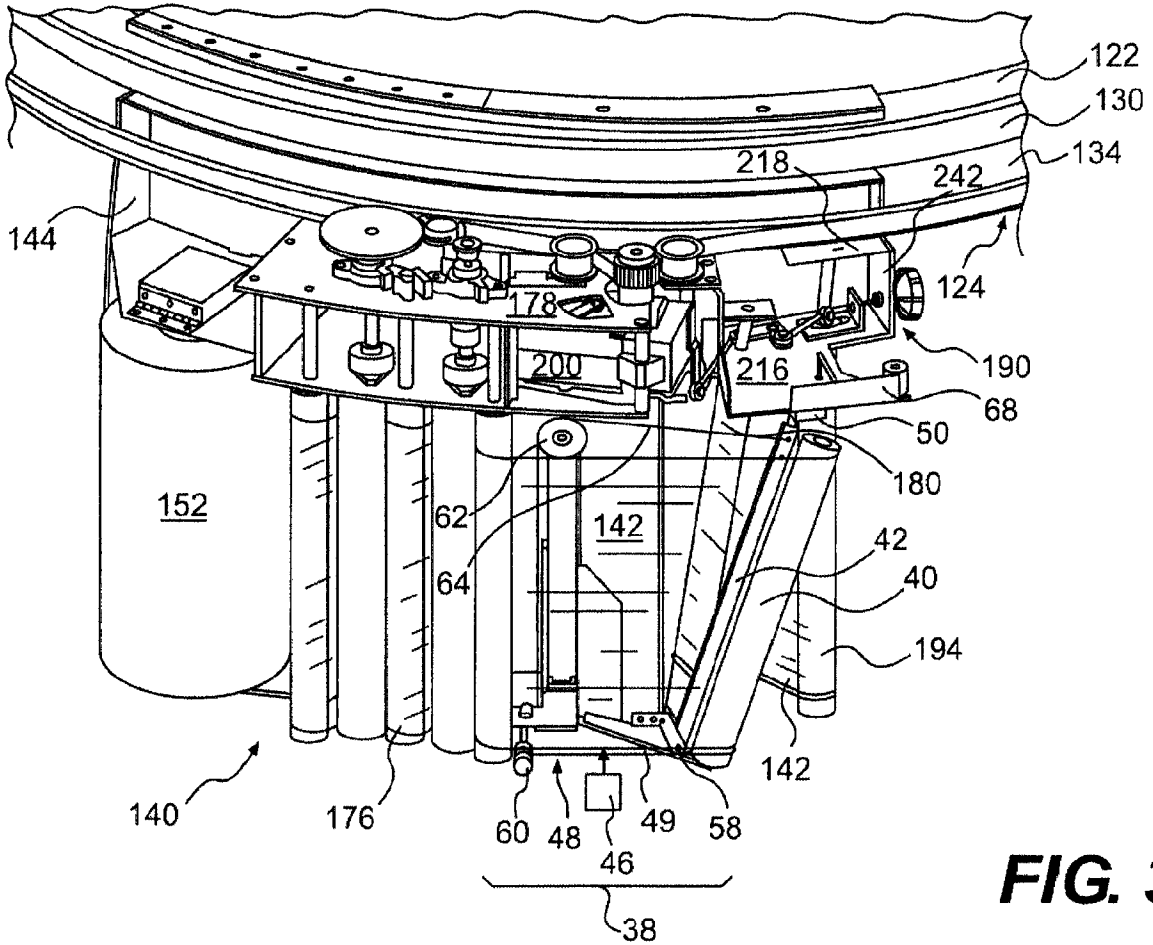
FIG. 3A is an isometric view of a roll carriage of the roll carriage including a packaging material dispenser with a pre-stretch portion, a film drive down portion, a virtual accumulator, and a film metering portion of FIG. 2, with certain elements in different positions, according to one aspect of the present disclosure.
Figure 3B:
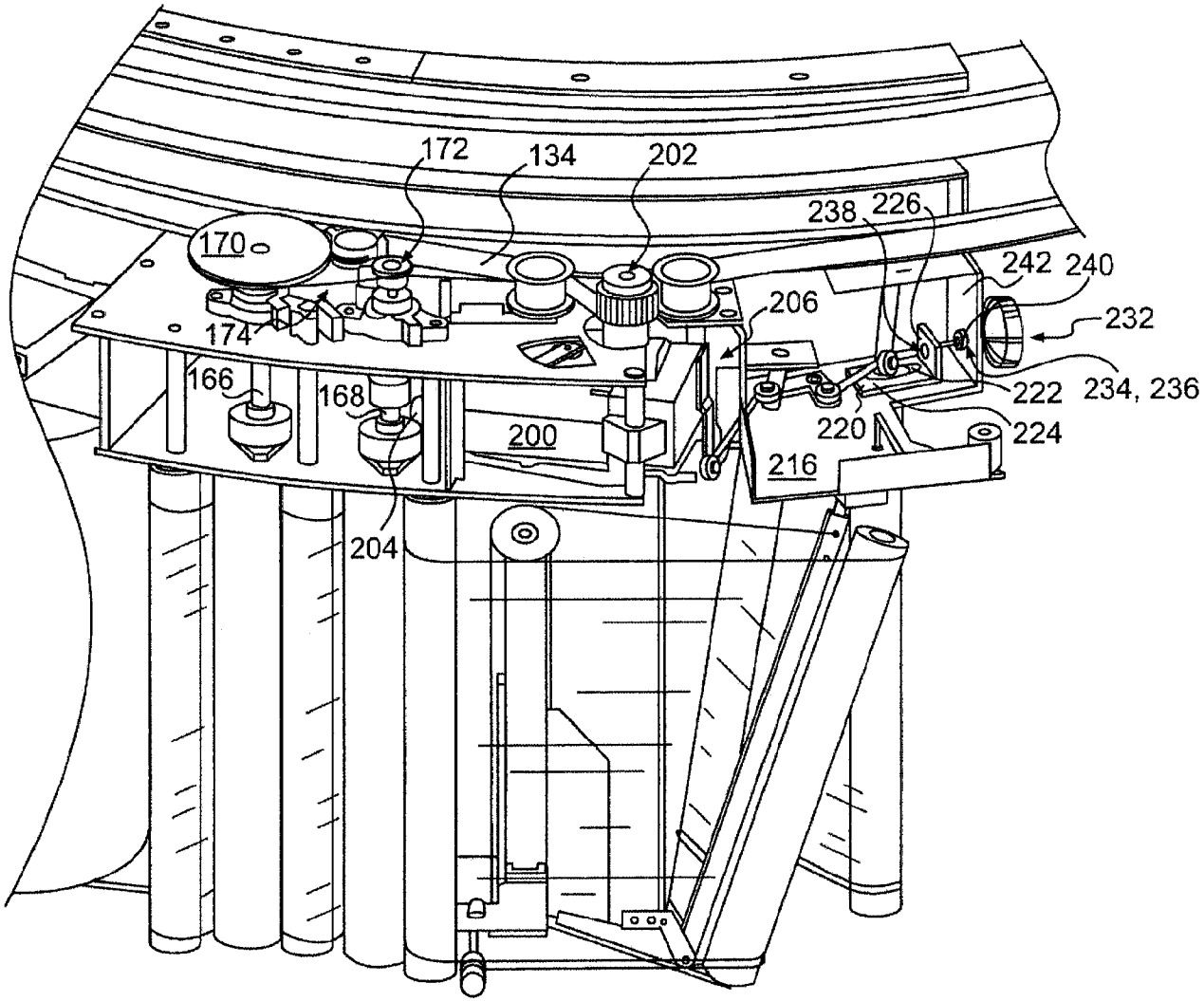
FIG. 3B is an enlarged portion of the isometric view of the roll carriage of FIG. 3A.
Figure 4:
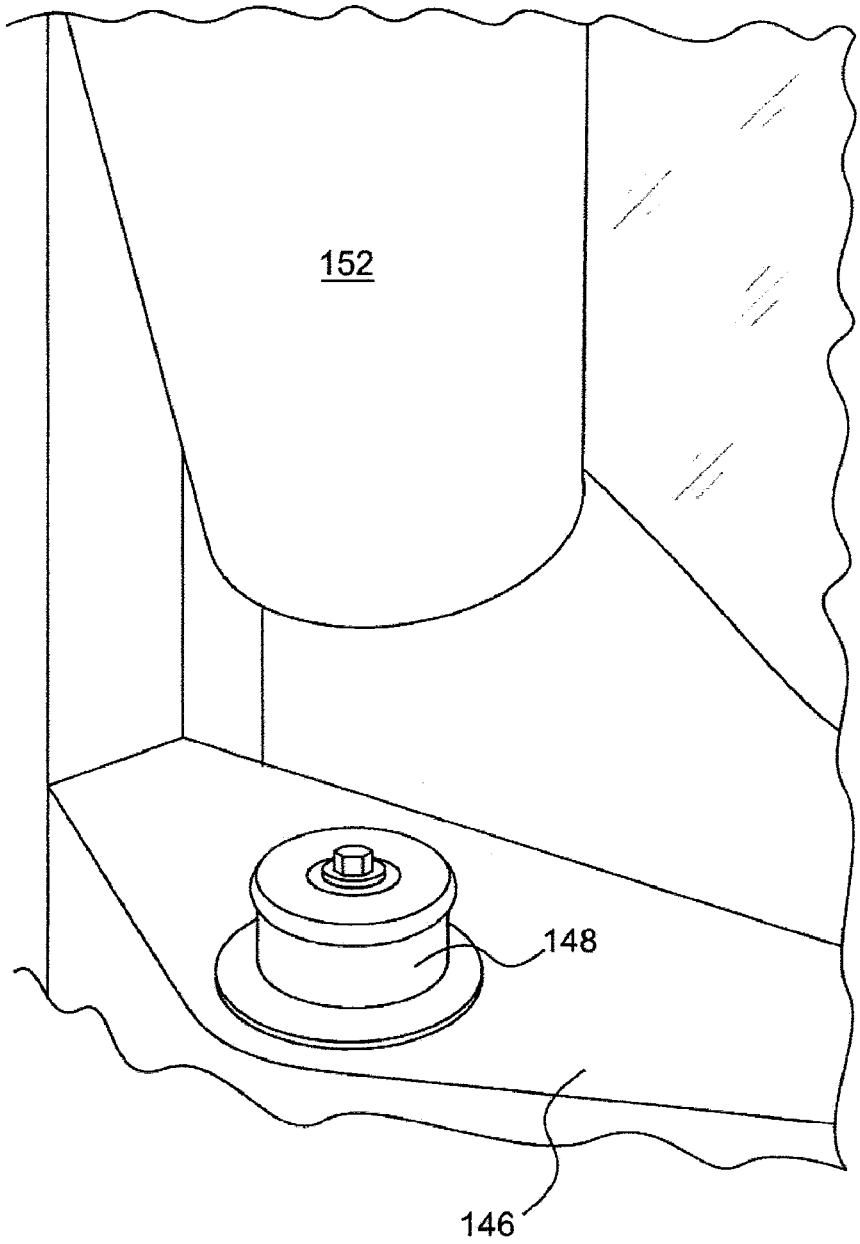
FIG. 4 is an isometric view of a lower film roll support on a roll carriage according to one aspect of the present disclosure.
Figure 5:
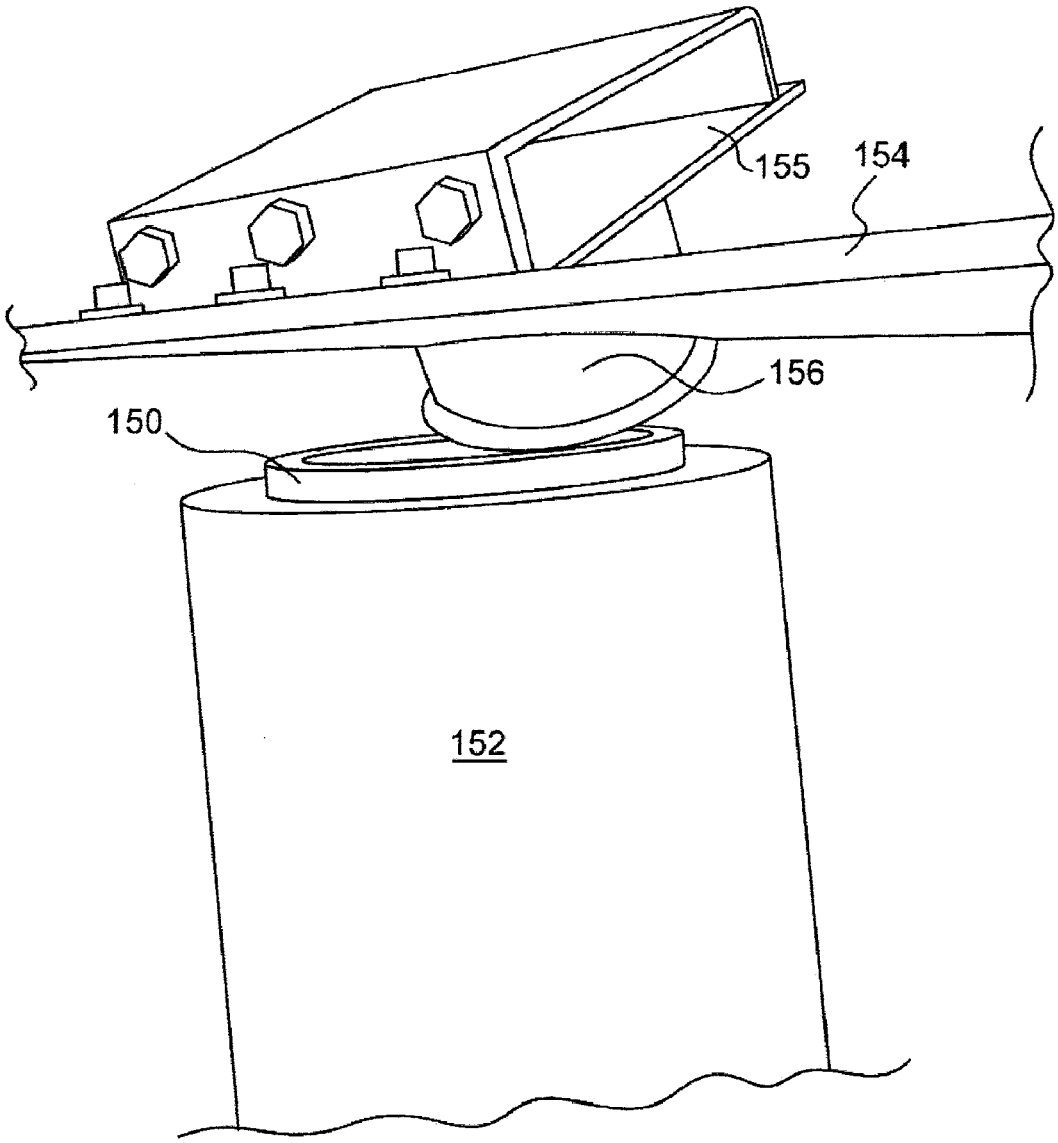
FIG. 5 is an isometric view of an upper film roll support on a roll carriage according to one aspect of the present disclosure.

As embodied herein and shown in FIGS. 1-3B, the stretch wrapping apparatus 100 may include a packaging material dispenser 140. As shown in FIGS. 2, 3A, and 3B, the packaging material dispenser 140 may dispense a sheet of packaging material 142 in a web form. The packaging material dispenser 140 may include a roll carriage 144. As embodied herein and shown in FIGS. 2-4, the roll carriage 144 may include a structure for supporting a roll 152 of packaging material 142. A lower support plate 146 includes a lower roll support 148 mounted thereon. It is contemplated that the lower roll support 148 may be configured to engage a core 150 of the roll 152 of packaging material 142, and may rotate as roll 152 rotates. Alternatively, roll 152 may rotate relative to the lower roll support 148. The roll carriage 144 may also include an upper support plate 154. The upper support plate 154 may include a rotatable plate 155 hingedly connected to the upper support plate 154 of the roll carriage 144 and include an upper roll support 156. The upper roll support 156 may be similar to the lower roll support 148 in structure and operation. The upper roll support 156 may be mounted on the rotatable plate 155. When removal of the roll 152 of packaging material 142 is desired, the rotatable plate 155 may be lifted, causing the rotatable plate 155 to rotate about a hinge, moving the upper roll support 156 out of engagement with the top of the core 150 of roll 152 of packaging material. This allows the remainder of the roll 152 to be easily removed from the lower roll support 148 and from the roll carriage 144. Insertion of a new roll 152 of packaging material 142 into the roll carriage 144 may be accomplished by reversing the steps, e.g., placing the bottom of the core 150 over the lower roll support 148, lifting the rotatable plate 155 to raise the upper roll support 156, sliding the roll 152 into position in the roll carriage 144, and then returning the rotatable plate 155 to its lowered position to allow the upper roll support 156 to engage the top of the core 150.

Preferably, the packaging material dispenser 140 is lightweight, which in combination with the lightweight rotatable ring 122 may allow for faster movement of the rotatable ring 122, and thus, shorter (faster) wrapping cycles. By using the second drive belt 134 to drive a pre-stretch assembly off of the rotational drive system, it is possible to eliminate the conventional motor that drives the packaging material dispenser 140 as well the conventional control box, greatly reducing the weight of the packaging material dispenser 140. By providing an entirely mechanical connection between the rotational drive system and the pre-stretch assembly, the need for placing electrical power sources or connections on the rotatable ring 122 for electrically powering the pre-stretch assembly may be eliminated.

In an exemplary embodiment, the packaging material 142 is stretch wrap packaging material. However, it should be understood that various other packaging materials such as netting, strapping, banding, or tape may be used as well. As used herein, the terms "packaging material," "film," "film web," "web," and "packaging material web" are interchangeable.

The packaging material dispenser 140 and rotatable ring 122 may rotate about a vertical axis 158 (FIG. 1) as the moveable frame 118 moves up and down the non-rotating frame 110 to spirally wrap packaging material 142 about a load 138. The load 138 can be manually placed in the wrapping area or conveyed into the wrapping area by the conveyor 114. As shown in FIGS. 1-3B, the packaging material dispenser 140 may be mounted underneath and outboard of the rotatable ring 122, thus maximizing wrapping space.

The packaging material dispenser 140 may include a pre-stretch assembly 160. Pre-stretch assembly 160 may include an upstream pre-stretch roller 162 and a downstream pre-stretch roller 164. "Upstream" and "downstream," as used in this application, are intended to define the direction of movement relative to the flow of packaging material 142 from the packaging material dispenser 140. Thus, since the packaging material 142 flows from the packaging material dispenser 140, movement toward the packaging material dispenser 140 and against the flow of packaging material 142 from the packaging material dispenser 140 may be defined as "upstream" and movement away from the packaging material dispenser 140 and with the flow of packaging material 142 from the packaging material dispenser 140 may be defined as "downstream."

The surfaces of the upstream and downstream pre-stretch rollers 162 and 164 may either be coated or uncoated depending on the type of application in which the stretch wrapping apparatus 100 is being used. The upstream and downstream pre-stretch rollers 162 and 164 may be mounted on roller shafts 166 and 168, respectively. Sprockets 170 and 172 may be located on the ends of the roller shafts 166 and 168, respectively, and may be configured to provide control over the rotation of the roller shafts 166 and 168 and the upstream and downstream pre-stretch rollers 162 and 164. It is contemplated that the upstream pre-stretch roller 162 and the downstream pre-stretch roller 164 may have different sized sprockets 170 and 172 so that the surface movement of the upstream pre-stretch roller 162 may be at least approximately 40% slower than that of the downstream pre-stretch roller 164. The sprockets 170, 172 may be sized depending on the amount of packaging material elongation desired. Thus, the surface movement of the upstream pre-stretch roller 162 can be about 40%, 75%, 200% or 300% slower than the surface movement of the downstream pre-stretch roller 164 to obtain pre-stretching of 40%, 75%, 200% or 300%. While pre-stretching normally ranges from 40% to 300%, excellent results have been obtained when narrower ranges of pre-stretching are used, such as pre-stretching the material 40% to 75%, 75% to 200%, 200% to 300%, and at least 100%. In certain instances, pre-stretching has been successful at over 300% of pre-stretch. The upstream and downstream pre-stretch rollers 162 and 164 may be operatively connected by a drive chain or belt 174.

Rapid elongation of the packaging material 142 by the pre-stretch rollers 162 and 164, followed by rapid strain relief of the packaging material 142, may cause a "memorization" effect. Due to this "memorization" effect, the packaging material 142 may actually continue to shrink for some time after being wrapped onto the load 138. Over time, the packaging material 142 may significantly increase holding force and conformation to the load 138. This characteristic of the packaging material 142 may allow it to be used for wrapping loads at very close to zero stretch wrapping force, using the memory to build holding force and load conformity. As previously noted, some embodiments of the present disclosure permit relative rotation between the load and dispenser at approximately 60 rpm. At this speed, the dispensed pre-stretched film has a tendency to billow around the load before contracting/shrinking onto the load such that the film contacts all sides/corners of the load substantially simultaneously. This is particularly beneficial when dealing with light, crushable, or twistable loads.

In one exemplary embodiment, each of the upstream and downstream pre-stretch rollers 162 and 164 may preferably be the same size, and each may have, for example, an outer diameter of approximately 2.5 inches. The upstream and downstream pre-stretch rollers 162 and 164 should have a sufficient length to carry a twenty (20) inch wide web of packaging material 142 along their working lengths, and they may be mounted on the roller shafts 166 and 168, which may include, for example, hex shafts. The upstream and downstream pre-stretch rollers 162 and 164, may be connected to each other through chains to a sprocket idle shaft with the sprockets 170 and 172 selected for the desired pre-stretch level. It is contemplated that, in one exemplary embodiment, rollers used for conventional conveyors may be used to form the upstream and downstream pre-stretch rollers 162 and 164.

As embodied herein and shown in FIGS. 2, 3A, and 3B, the pre-stretch assembly 160 may include a midstream idle roller 176 positionable between the upstream and downstream pre-stretch rollers 162 and 164. The midstream idle roller 176 may be the same diameter as or smaller in diameter than the upstream and downstream pre-stretch rollers 162 and 164. Preferably, midstream idle roller 176 is uncoated. In one exemplary embodiment, midstream idle roller 176 may include an idle roller operatively connected to an upper frame portion 178 of the packaging material dispenser 140. The midstream idle roller 176 may also be a cantilevered roller that is not connected to any additional structure and is unsupported at its base. Although not physically connected at its base or to a base support, the midway idle roller 176 may nest in a U-shaped guard (not shown) that connects the upstream and downstream pre-stretch rollers 162 and 164 as disclosed in U.S. patent application Ser. No. 11/371,254, filed Mar. 9, 2006, and entitled "Stretch Wrapping Apparatus Having Film Dispenser with Pre-Stretch Assembly," the entire disclosure of which is incorporated herein by reference. Preferably the midstream idle roller 176 may be aligned to provide a pinching action on the upstream pre-stretch roller 162, as disclosed in U.S. Pat. No. 5,414,979, the entire disclosure of which is incorporated herein by reference. Additional idle rollers may be provided adjacent the upstream and downstream pre-stretch rollers 162 and 164 as necessary to direct the film path.

According to another aspect of the present disclosure, the packaging material dispenser 140 may include a final idle roller 180 positioned downstream of the second downstream pre-stretch roller 164. Spacing the final idle roller 180 downstream of the last pre-stretch roller 164 may provide an extra length 182 of packaging material 142 between the downstream pre-stretch roller 164 and the final idle roller 180 mounted on the packaging material dispenser 140. See FIG. 7. The extra length 182 of packaging material 142 may provide the additional elasticity in the pre-stretched packaging material 142 to accommodate the passage of a corner of the load 138 or to accommodate offset and/or off-center loads. The extra length 182 of packaging material 142 provides the same benefits as a film accumulator or a dancer bar without require the usual structure and connections required by such. For this reason, the extra length 182 of packaging material 142 may also be referred to as a "virtual accumulator" 182.

Figure 7:
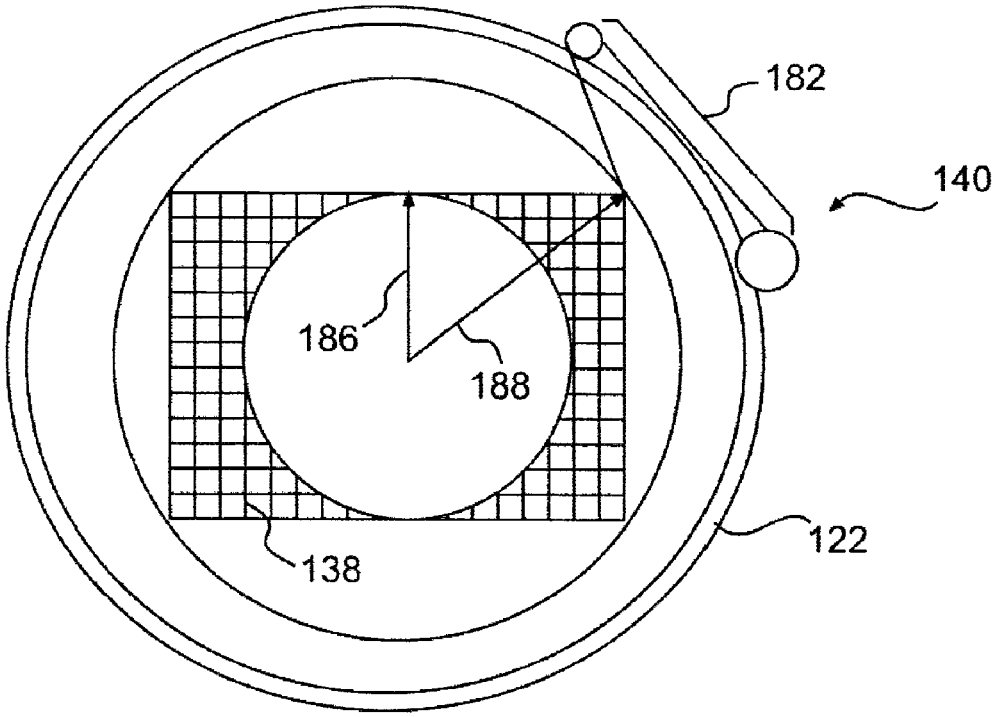
FIG. 7 is a top view of a load being wrapped and illustrating the shortest wrap radius and the longest wrap radius according to one aspect of the present disclosure.

The virtual accumulator 182 may also permit the length of packaging material 142 to the load 138 to always be longer than at least one side of the load 138. Preferably, the final idle roller 180 is positioned to provide an extra length 182 of packaging material 142 that is equal to a length greater than a difference between the shortest wrap radius of a load and the longest wrap radius of a load 138. FIG. 7 illustrates the wrap radii with regard to a rectangular load 138 and shows that the shortest wrap radius 186 can be found along the middle of the side of the load and the longest wrap radius 188 can be found at a corner of the load 138. By providing an extra length 182 of film 142 that is greater than the difference between these two radii, there is sufficient extra film 142 to accommodate movement from the shortest wrapping radius 186 to the longest wrapping radius 188.

Experimentation, and observation of the geometry of the wrap process revealed that the virtual accumulator 182 produces significant dampening of the force variation when the load is relatively centered. A 40×48 rectangular load would add approximately 13 inches to the film length. Although less than this will be required where the load does not "fill the ring wrap space" since the film from the final idle roller to the load will be more, testing has shown that a minimum length of 13 inches should be used. Depending on the positioning of the load, a maximum of length of up to about 88 inches of extra film may be used. The optimum length, considering threading and film roll change, has been found to be approximately 29 inches between the downstream pre-stretch roller 164 and the final idle roller 180 mounted to the roll carriage 144. It should be noted that the distance from the final idle roller 180 to the load 138 constantly varies as the corners of the load 138 pass. If the ring is "filled," the passage of a corner of the load 138 may permit only inches of film to the final idle roller 180.

As shown in FIGS. 2, 3A, and 3B, the packaging material dispenser 140 may also include a pre-stretch packaging material metering assembly 190. The pre-stretch packaging material metering assembly 190 may include a mechanical input/output ratio control 192, a film break sensing roller 194, and a metering adjustment control 196.

As embodied herein, the second drive belt 134 forms a first part of a mechanical connection between the rotational drive system and the pre-stretch assembly 160. The mechanical input/output ratio control 192 forms the second part of the mechanical connection between the rotational drive system and the pre-stretch assembly 160. As shown in FIGS. 2, 3A, and 3B, the mechanical input/output ratio control 192 may be a variable transmission such as, for example, a hydrostatic transmission 200. One exemplary such hydrostatic transmission is made by Hydrogear, model number BDR-311. The hydrostatic transmission 200 may include a first rotatable input shaft 202 and a second rotatable output shaft 204. A series of hydraulic pumps and valves control the ratio between the input and the output of the hydrostatic transmission 200. This ratio may be set as desired. As shown in FIGS. 1-3B, the second drive belt 134 may engage the rotatable input shaft 202 of the hydrostatic transmission 200 on the roll carriage 144 of the packaging material dispenser 140. During operation of the apparatus 100, the motor 132 drives the first drive belt 130, which in turn rotates the rotatable ring 122 and the packaging material dispenser roll carriage 144 mounted on the rotatable ring 122. As the roll carriage 144 rotates with the ring 122, the second drive belt 134 on fixed ring 124 engages the rotatable input shaft 202 of the hydrostatic transmission 200, causing the input shaft 202 to rotate. Thus, the second drive belt 134 translates the rotational drive from the rotatable ring 122 to the hydrostatic transmission 200. The output of the hydrostatic transmission 200, via the rotatable output shaft 204, drives the downstream roller 164 of the pre-stretch assembly 160, and through the connection 174 between the pre-stretch rollers 162, 164, the upstream pre-stretch roller 164. As the pre-stretch rollers 162, 164 rotate, the packaging material 142 flows downstream from the packaging material roll 152 through the pre-stretch assembly 160, through the pre-stretch packaging material metering assembly 190 and to the load 138, as will be discussed in greater detail below.

As embodied herein, the hydrostatic transmission 200 may include a rotatable input shaft 202 that engages the fixed second drive belt 134 through gear teeth or any other suitable mode of engagement. Accordingly, when the rotatable ring 122 and the roll carriage 144 are rotatably driven by the first drive belt 130 via the motor 132, the movement of the roll carriage 144, including the rotatable input shaft 202, relative to the fixed second drive belt 134 causes rotation of the rotatable input shaft 202. The hydrostatic transmission 200 may be set to control a ratio of the relative rotational speed to pre-stretch speed by controlling a ratio of drive input to drive output. The speed at which the rotatable input shaft 202 rotates, based on the speed at which the rotatable ring 122 and the roll carriage 144 rotate, may be considered the input. The series of pumps and valves contained within the hydrostatic transmission 200 transmit the input from the input shaft 202 to the output shaft 204, adjusting the rotational speed of the output shaft 204 based on the input/output ratio of the hydrostatic drive 200.

The rotation of the rotatable output shaft 204 drives the downstream pre-stretch roller 164. The connection 174 between the upstream and downstream pre-stretch rollers 162, 164 causes the upstream pre-stretch roller 162 to rotate as the downstream pre-stretch roller 164 rotates, thus dispensing film 142. Engagement between the rotatable output shaft 204 and the downstream pre-stretch roller 164 may include, for example, drive belts, gears, chains, and/or any other suitable devices configured to convert rotation of the rotatable output shaft 204 into rotation of the upstream and downstream pre-stretch rollers 162, 164. In the exemplary embodiment, the hydrostatic transmission 200 may have a ninety degree angle between its rotatable input shaft 202 and its rotatable output shaft 204. Although a hydrostatic drive is used in the exemplary embodiment, any other appropriate mechanical power transmissions may be used to control the input/output ratio. Further, other suitable mechanical controls such as, for example, a split sheave, variable pitch belt sheaves, fixed center and adjustable center sheaves, wider range variable pitch belt drives, cone and ring variable speed drives, rolling ring variable speed drives, and ball and ring variable speed drives may be used to control the input/output ratio. Alternatively, methods such as a moving second ring with the differential between the rings generating the output, using a differential and controlling one output to adjust another output, and an electric motor without load cell feedback.

The input/output ratio of the hydrostatic transmission 200 may be selectively and variably adjusted. As the input/output ratio increases, the relative speed of the output shaft 204 increases, and the rotational speed of the upstream and downstream pre-stretch rollers 162 and 164 increases proportionally. The increased rotational speed of the upstream and downstream pre-stretch rollers 162 and 164 causes an increase in the supply rate of the packaging material 142. If, on the other hand, the input/output ratio decreases, then the speed of the rotational output shaft 204 decreases, and the relative rotational speed of the upstream and downstream pre-stretch rollers 162 and 164 decreases proportionally, resulting in a decrease in the supply rate of the packaging material 142. Thus, it should be apparent that while the rotatable ring 122 and the rotatable input shaft may rotate at substantially the same speed, the rotational speed of the rotatable output shaft 204, and consequently the rotational speed of the upstream and downstream pre-stretch rollers 162 and 164 may vary depending on the input/output ratio setting of the hydrostatic transmission 200.

A transmission lever 206 may be operatively coupled to the hydrostatic transmission such that the orientation of the transmission lever 206 may affect the input/output ratio of the hydrostatic transmission 200. For example, the transmission lever 206 may be adjusted to a first position, where the transmission lever 206 may set a minimal input/output ratio such that the speed of the rotatable input shaft 202 is much greater than the speed of the rotatable output shaft 204 and thus the downstream pre-stretch roller 164. It is contemplated that in the first position, the transmission lever 206 may prevent input at the rotatable input shaft 202 from being transmitted/translated to the rotatable output shaft 204. This may be accomplished, for example, by controlling a valve positioned between an input pump and an output pump in the hydrostatic transmission. With the transmission lever 206 in such a position, the hydrostatic drive is essentially in neutral. It can accept an input from the rotatable input shaft 202 but does not produce an output through the rotatable output shaft 204. The transmission lever 206 may also be adjusted to a second position, where the transmission lever 206 may allow for a maximum input/output ratio. The transmission lever 206 may be adjusted to virtually any position between the first and second positions, causing changes in the input/output ratio and thus ratio of relative rotational speed to pre-stretch speed. Changes in the input/output ratio and the ratio of relative rotational speed to pre-stretch speed result in changes to the relative speed of the rotatable output shaft 204. Accordingly, the input/output ratio may vary between a maximum ratio and a minimum ratio, depending on the angular orientation of the transmission lever 206 relative to the hydrostatic transmission 200, and the output of the hydrostatic transmission 200. The speed of downstream pre-stretch roller 164, and thus the amount of film dispensed by the pre-stretch assembly 160, varies based on the input/output ratio.

According to one aspect of the present disclosure, a metering adjustment control 196 may be provided. The metering adjustment control 196 may include, for example, a sliding plate 220 having a slot 222 therein extending through a first surface 224. The sliding plate 220 may also include a second surface 226 extending substantially perpendicularly to the first surface 224. The first surface 224 of the sliding plate 220 may rest on the lower frame portion 216 of the packaging material dispenser 140, and may be configured to slide thereon. The slot 222 in the sliding plate 220 may be arranged such that it at least partially overlaps a slot (not shown) in the lower frame portion 216 of the packaging material dispenser 140. The metering adjustment control 196 may include an adjustment knob 232 and a bolt assembly, including a bolt 234 and a nut 236. The bolt 234 may be inserted through an aperture 238 in the second surface 226 of the sliding plate 220, and may also extend through an aligned aperture 240 in a side frame portion 242 of the packaging material dispenser 140. Rotation of the adjustment knob 232 in a first direction may draw the bolt 234 towards the adjustment knob 232, causing the sliding plate 220 to slide in a first direction. Rotation of the adjustment knob 232 in a second direction (opposite the first direction) may cause the sliding plate 220 to slide away from the adjustment knob 232. Accordingly, an operator may selectively determine the input/output ratio of the hydrostatic transmission 200 by adjusting the adjustment knob 232. The position of the sliding plate 220, through a series of linkages, adjusts the input/output ratio of the hydrostatic transmission 200, and thus, the supply rate of packaging material 142. Thus, by using the adjustment knob 232 to position the sliding plate 220 in a predetermined position, an operator can set the input/output ratio of the hydrostatic transmission 200, thereby setting the rotational speed of the pre-stretch rollers relative to the speed of the rotatable ring 122. This in turn "sets" the pre-stretch rollers 162, 164 to dispense a predetermined substantially constant length of film per revolution of the rotatable ring 122.

In situations when the packaging material apparatus is to be used for loads having different girths, the adjustment knob 232 of the metering adjustment control 196 should be positioned to adjust the payout percentage for the girth of the load and wrap force desired. Setting the payout percentage with knob 232 will set the input/output ratio of the hydrostatic transmission 200, ultimately determining the amount of packaging material 142 that will be distributed per revolution of the upstream and downstream pre-stretch rollers 162 and 164. Thus, to wrap larger girth loads, more packaging material will be required per revolution and thus the ratio of relative rotational speed to pre-stretch speed should be higher to permit a higher predetermined substantially constant length of packaging material to be distributed for each revolution. On the other hand, if the load has a small girth, less packaging material will be required per revolution and thus the ratio of relative rotational speed to pre-stretch speed should be lower to permit a smaller predetermined substantially constant length of packaging material to be dispensed per revolution of the rotatable ring 122. Thus, adjustment of the metering adjustment control 196 may allow an operator to selectively adjust the input/output ratio of the transmission 200 and thus the rotational speed of the pre-stretch rollers 162 and 164, and the supply rate of the packaging material 142, such that the stretch wrapping apparatus 100 may be used to wrap loads have varying shapes and sizes. Therefore, by adjusting the input/output ratio, an operator is adjusting the speed of the pre-stretch rollers proportional to the rotational ring speed.

According to another aspect of the present disclosure, a film break sensing roller 194 may be provided. The film break sensing roller 194 may be operatively coupled to the transmission lever 206 through a series of linkages. The film break sensing roller 194 may be mounted to the roll carriage 144 on a shaft 212. The film break sensing roller 194 may have an outer diameter of approximately 2.5 inches, and may have a sufficient length to carry a twenty (20) inch wide web of packaging material 142 along its working length. In one embodiment, bearings for supporting the shaft 212 may be press-fit or welded into each end of the film break sensing roller 194, and the shaft 212 may be placed therethrough, such that the shaft 212 may be centrally and axially mounted through the length of the film break sensing roller 194.

The primary purpose of the film break sensing roller 194 is to completely stop film feed as quickly as possible when the film 142 breaks so that the film 142 does not backlash and wind up on the rollers. During normal operation of the stretch wrap apparatus 100, tension in the packaging material 142 holds the film break sensing roller 194 in a "full forward" position (i.e., retracted toward pre-stretch assembly 160). When the film break sensing roller 194 moves from the "full forward" position to a "neutral" position due to tension release in the packaging material 142, the film break sensing roller 194 extends away from the pre-stretch assembly 160. The hydrostatic transmission moves to a neutral position, i.e., to a position where the output of the hydrostatic transmission 200 goes to zero even with continued input into the hydrostatic transmission due to the continued rotation of the rotatable ring 122 and the packaging material dispenser 140. A secondary purpose of the film break sensing roller 194 is that it may sense slack film. For example, if the girth of the load 138 is radically reduced (as in a few boxes on the only top layer of the load) the film break sensing roller 194 senses slack film (which feels the same as a film break) and begins to move towards the "neutral" position. As the film break sensing roller 194 moves toward the neutral position, the input/output ratio of the hydrostatic drive decreases, slowing the film feed. As the film feed slows and the rotatable ring continues to rotate, the slack is taken up as the smaller top layer is wrapped and the film break sensing roller 194 remains in the position at which it no longer senses the slack, establishing a new film feed position and input/output ratio where less film/revolution is dispensed.

As embodied herein and shown in FIGS. 3A and 3B, the film break sensing roller 194 may be mounted on a shaft 212. A first end of the shaft may extend through a slot 214 in a lower frame portion 216 of the packaging material dispenser 140, and may be pivotally attached to an upper support plate 218 of the packaging material dispenser 140. Additionally, the shaft 212 may be cantilevered, such that a second end of the shaft may hang freely. Consequently, the film break sensing roller 194 may swing back and forth between extended (neutral) and retracted (full forward) positions. The swinging movement of the film break sensing roller 194 may be linked to the rotation of the transmission lever 206 as the film break sensing roller 194 may be coupled to rotate with the transmission lever 206 through a series of linkages.

According to another aspect of the present disclosure, the stretch wrapping apparatus 100 may be provided with a belted packaging material clamping and cutting apparatus as disclosed in U.S. Pat. No. 4,761,934, the entire disclosure of which is incorporated herein by reference. The packaging material 142 may be sealed to the layers of wrap on the load 138 by any conventional means such as by heat sealing and by the use of wipe down mechanisms. Further, heated cutting and sealing elements as known in the art may be used. Also, the sealing systems may be automatic, semi-automatic, or manually operated.

According to another aspect of the present disclosure, the stretch wrapping apparatus 100 may be provided with a film drive down and roping system as disclosed in U.S. patent application Ser. No. 10/767,863, filed Jan. 30, 2004, and entitled "Method and Apparatus for Rolling a Portion of a Film Web into a Cable" and in U.S. patent application Ser. No. 11/709,879, filed Feb. 23, 2007, and entitled "Method and Apparatus for Securing a Load to a Pallet with a Roped Film Web," the entire disclosures of which are incorporated herein by reference.

As shown in FIGS. 2, 3A, and 3B, the stretch wrap apparatus 100 may include a film drive down assembly 38. The film drive down assembly 38 may include a film drive down roller 40, a film drive down roller support 42, an actuation mechanism 46, a roping apparatus 48, and a latching assembly 50. The film drive down roller support 42 may include a shaft 52, a leg 54 extending substantially alongside the shaft 52, and a lever 56. The lever 56 may extend at an angle from a bottom end of the leg 54. The shaft 52 may rotatably support the film drive down roller 40. The film drive down roller support 42 may be rotatably mounted by a pivot connection 58 on its bottom end either directly or indirectly to the packaging material dispenser 140. The top end of the film drive down roller support 42 may move freely, and thus, the entire film drive down roller support 42 may rotate about an axis extending through the pivot connection 58, allowing the film drive down roller support 42 to move between a relatively vertical position and a tilted film drive down position, shown in FIGS. 2 and 3A, respectively. When the film drive down roller 40 is in the tilted film drive down position (FIG. 3A), the film web 142 will enter onto the surface of the film drive down roller 40 at a first height. Due to the tilted orientation of the film drive down roller 40, the film web 142 will be forced downward as it travels around the film drive down roller 40, coming off of the film drive down roller 40 at a lower height than when film web 142 entered.

Rotation of the film drive down roller support 42 about the pivot connection 58 may be achieved using the actuation mechanism 46 shown in FIG. 3A. The actuation mechanism 46 may selectively engage the lever 56 during certain times in a wrap cycle. The actuation mechanism 46 may include, for example, an air cylinder activated pad, and/or any other suitable mechanical, electrical, or hydraulically powered device configured to project outwardly to abut and drive the lever 56 upwardly, thus causing clockwise rotation of the film drive down roller support 42 and the film drive down roller 40 from the relatively vertical position of FIG. 2 to the tilted film drive down position of FIG. 3A. The film drive down roller 40 may remain in contact with the film web 142 throughout the wrap cycle, whether the film drive down roller 40 is in the relatively vertical position or in the tilted film drive down position.

In one embodiment, the actuation mechanism 46 may cause tilting of the film drive down roller 40 at the start of the wrap cycle, when the packaging material dispenser 140 is in the initial position. After abutting the lever 56, the air cylinder activated pad may retract inwardly out of the path of travel of the packaging material dispenser 140 as relative rotation is provided between the packaging material dispenser 140 and the load 138. Additionally or alternatively, the actuation mechanism 46 may include an abutment, wherein the packaging material dispenser 140 may be lowered while not rotating to bring the abutment into contact with the lever 56 and cause rotation of the film drive down roller support 42. Prior to providing relative rotation between the packaging material dispenser 140 and the load 138, the packaging material dispenser 140 may be moved so as not to be obstructed by the abutment.

The roping apparatus 48 may be configured to engage a least a portion of a bottom edge of the film web 142. The roping apparatus 48 may include, for example, a cable rolling roper element 60, a pulley 62, and a linking cable 64. The cable rolling roping element 60 may be slidably or otherwise moveably mounted either directly or indirectly to the packaging material dispenser 140, such that the cable rolling roping element 60 may move upward and downward relative to the packaging material dispenser 140. In FIGS. 2 and 3A, the cable rolling roping element 60 is shown in lowered and raised positions, respectively. The cable rolling roping element 60 may move in between the lowered and raised positions due to movement of the film drive down roller support 42, which may be operatively connected to the cable rolling roping element 60 by the linking cable 64. In one embodiment, the linking cable 64 may include a first end looped or otherwise attached to the cable rolling roping element 60, and a second end looped or otherwise attached to an upper portion of the film drive down roller support 42. When the film drive down roller support 42 is in the relatively vertical position of FIG. 2, the cable rolling roping element 60 may be in the lowered position. When the film drive down roller support 42 rotates towards the tilted film drive down configuration, it may pull on the linking cable 64. The pulling force may be translated by the pulley 62 into an upward movement of the first end of the linking cable 64, causing the cable rolling roping element 60 to move towards the raised position. As long as guide roller support 42 remains in the tilted film drive down configuration, the roping element 60 may remain in the raised position. When the film drive down roller support 42 is released from the tilted film drive down configuration, and moves back to the relatively vertical position, the cable rolling roping element 60 may move back to the lowered position. The cable rolling roping element 60 may be positioned downstream of and adjacent to an upstream idle roller 34.

Figure 8:
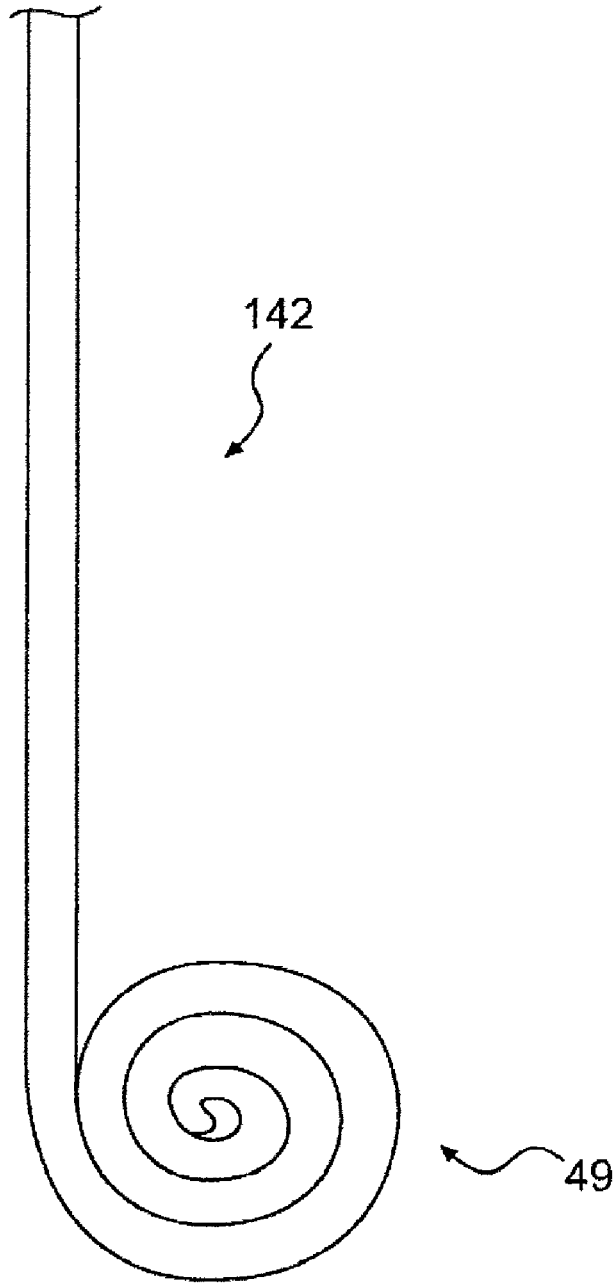
FIG. 8 is a side view of a rolled portion of packaging material formed into a cable according to one aspect of the present disclosure.

Preferably, the cable rolling roping element 60 may include low friction materials, for example unpainted steel bars or elements coated with zinc chromate. The cable rolling roping element 60 may have a v-shaped circumferential groove for engaging the film web 142. The cable rolling roping element 60 works with the film drive down roller 40 to create a rolled rope 49 of film that is capable of maintaining its structural integrity as a rope structure during and after wrapping of a load. The cable rolling roping element 60 and film drive down roller 40 may form a "cable rolling means" for rolling a portion of the film web into a cable of film. The cable rolling means rolls an outer edge of the film web inward upon itself and toward the center of the film web. The film is rolled upon itself to form a tightly rolled cable of film, or a high tensile cable of film along an edge of the film web 142. As used herein, a "cable of film" or a "rolled cable" or a "rolled rope" are intended to denote a specific type of "roped" packaging material, where the film web has been rolled upon itself to create the rolled cable structure. An example is shown in FIG. 8.

Once the film drive down roller support 42 rotates into the position shown in FIG. 3A, it may engage the latching mechanism 50. The latching mechanism 50 may include a catch, configured to receive and hold a bolt member 66 mounted to the top end of the film drive down roller support 42. As long as the bolt member 66 is held in the catch, the film drive down roller support 42 and the film drive down roller 40 may be locked in the tilted film drive down position, and thus, the roping element 60 may be held in the raised position. In order to release the bolt member 66, the latching mechanism 50 may include a release device 68. Actuation of the release device 68 may serve to unlock (release) the catch to allow the bolt member 66 to escape, thus allowing the film drive down roller support 42 and film drive down roller 40 to return to the relatively vertical position of FIG. 2. The release device 68 may include, for example, a spring steel release pad. The spring steel release pad 68 may be configured to engage an abutment 69 mounted on a non-rotating frame 71, such as, for example, a roller or wheel. At a pre-determined point in the wrap cycle, the spring steel release pad 68, may be brought into contact with the abutment 69, causing the spring steel release pad 68 to bend inwardly in the direction of the load. That inward movement of the spring steel release pad 68 may actuate the catch into an unlocking position, allowing the bolt member 66 to escape. Continued movement of the packaging material dispenser 10 may disengage the abutment 69 from the spring steel release pad 68, which may bend back outwardly due to its inherent resiliency. The catch may be returned to the locking position by the outward movement of the spring steel release pad 68 and/or by the force generated by a return spring or other suitable biasing device. The next time in the wrap cycle that the film drive down roller support 42 moves to the tilted film drive down position, the bolt member 66 may once again be received and held by the catch.

According to another aspect of the disclosure, a method of using the stretch wrapping apparatus 100 will now be described. In operation, the load 138 may be manually placed in the wrapping area or may be conveyed into the wrapping area by the conveyor 114. The girth of the load 138 may be determined, and a substantially constant length of packaging material 142 to be dispensed for each revolution of the packaging material dispenser 140 and rotatable ring 122 may be subsequently determined based on that girth. The substantially constant length of packaging material 142 to be dispensed per revolution may be between approximately 90% and approximately 130% of the load girth, and preferably may be between approximately 95% and approximately 115% of load girth, and most preferably may be approximately 107% of load girth. Once the substantially constant length of packaging material 142 to be dispensed per revolution of the rotatable ring 122 is known, the mechanical input/output ratio control 192 of the pre-stretch packaging material metering assembly 190 may be set through use of the metering adjustment control 196. The setting of the input/output ratio of the variable transmission (hydrostatic transmission 200) sets the ratio of the relative rotational speed (i.e., speed of the rotatable ring) to the pre-stretch speed (i.e., pre-stretch roller surface speed).

A leading end of the packaging material 142 may be threaded through the upstream and downstream pre-stretch rollers 162 and 164, and around any middle idle rollers 176 of pre-stretch assembly 160. Then, the leading end of the packaging material 142 may be wrapped around the film break sensing roller 194 and a final idle roller 180, and then may be attached to the load 138 using a film clamp, or by tucking the leading end of the packaging material 142 into the load 138. It is noted that if the spacing between the pre-stretch rollers 162, 164 and the film break sensing roller 194 is sufficient to provide the extra length 182 of film 142, a final idle roller 180 may not be used. Additionally, the final idle roller 180 may be located anywhere within the film path between the downstream pre-stretch roller 164 and the load 138 that will provide the desired extra length 182 of film 142.

The first motor 132 may operate to rotate the first drive belt 130 and thus the rotatable ring 122 and the packaging material dispenser 140 around the load 138. As the packaging material dispenser 140 rotates relative to the fixed ring 124, the fixed second drive belt 134 may be picked up by a pulley system 250 mounted to the rotatable ring 122 and move relative to the rotatable input shaft 202 of the hydrostatic transmission 200, causing the rotatable input shaft 202 to rotate. As the rotatable ring 122 rotates, a tensile force may be created in the length of the packaging material 142 extending between the load 138 and the film break sensing roller 194. That tensile force may tend to pull the film break sensing roller 194 toward its retracted (full forward) position.

Rotation of the input shaft 202 is translated to output shaft 204 according to the set input/output ratio, and the rotation of the output shaft 204 in turn causes rotation of the downstream pre-stretch roller 164 and thus, via the connector and sprockets, the upstream pre-stretch roller 162. As the upstream and downstream pre-stretch rollers 162 and 164 rotate, they may elongate the packaging material 142 and dispense a predetermined substantially constant length of pre-stretched packaging material 142 during each revolution of the rotatable ring 122. The packaging material dispenser 140 may rotate about a vertical axis 158 as the moveable frame 118 moves up and down the non-rotating frame 110 to spirally wrap packaging material 142 about the load 138.

During the wrapping cycle, the film break sensing roller 194 may sense the occurrence of packaging material breaks. For example, if a break occurs in the length of packaging material 142 extending between the load 138 and the film break sensing roller 194, the tensile force holding the film break sensing roller 194 in the full forward position will cease to exist. The film break sensing roller 194 will then rapidly move toward its extended (neutral) position, thus causing the rotational speed of the pre-stretch rollers 162 and 164 and the supply rate of packaging material 142 to rapidly decrease to zero. This rapid decrease coincides with the shifting of the hydrostatic transmission to neutral. Thus, the ring 122 may still be rotating and providing input to the hydrostatic transmission 200, but the hydrostatic transmission 200 provides no output. This ensures that the pre-stretch assembly 160 will not continue to dispense packaging material 142 after a break occurs and thus prevents back lash and winding of the film on the rollers.

It is also contemplated that a sensor device, such as for example, a photo-cell sensor, may be placed on the packaging material dispenser 140 to detect the orientation of the film break sensing roller 194. The sensor device may be configured to send a signal to a controller to bring the apparatus 100 back to a home position and stop. It may additionally signal an operator that there has been a failure.

According to yet another aspect of the disclosure, the mechanical connection between the rotational drive system and the pre-stretch assembly may be replaced by an electrical connection. In such an embodiment, two separate drives may be provided, a first rotational drive for providing relative rotation between the load and the packaging material dispenser, and a second rotational drive for rotating the pre-stretch rollers of the pre-stretch assembly. The two rotational drives may be electronically linked such that a ratio of the drive speeds remains constant throughout a primary portion of the wrap cycle in order to permit the pre-stretch assembly to dispense a predetermined substantially constant length of film for each revolution of the dispenser relative to the load. A means for providing relative rotation between the load and the dispenser may include any of the systems previously discussed, e.g., vertical or horizontal rings, rotatable arms, and turntables.

An electrical connection, such follower circuits, for example a tachometer follower, or encoders may be used to link the first rotational drive and the second rotational drive such that a ratio of the drive speeds remains constant throughout a primary portion of the wrap cycle. In this manner, the electronic connection mimics the mechanical connection previously described Unlike the mechanical connection, there may be times when it is undesirable for the two drives to be proportionally controlled at the same ratio for the entire wrap cycle. There may be times when it is instead desirable to vary the ratio while continuing to proportionally control the drives. Such times include start of the wrap cycle to accommodate prior art clamping systems and at the end of a wrap cycle to accommodate limitations of prior art film cutting and wiping systems or when one of the rotational drives may be moving in an opposite direction from the other (e.g., backing up the dispenser to provide slack in the film). Additionally there may be other reasons to vary the ratio for special applications such as corner board insertion, securing slip sheet flaps, etc. In addition, should the film break or become slack, it would be undesirable to have the pre-stretch assembly continue to dispense film that wind up the rollers.

According to an exemplary embodiment of the disclosure, two AC variable frequency drives, such as Allen-Bradley Power Flex 40 drives, may be used to drive the relative rotation between the load and the dispenser and to drive the pre-stretch rollers. A Control Logix processor may be used to electronically control the speed of the drives relative to one another so as to permit the pre-stretch assembly to dispense a predetermined substantially constant length of film for each revolution of the dispenser relative to the load. Preferably, an interface will be provided that permits the operator to select the payout percentage.

According to one aspect of the disclosure, a corner lock mechanism may be provided. The corner lock mechanism of may include a set of programmable controls (not shown), a plurality of corner targets (not shown) such as flags on a load support surface positioned just before each corner of the load and a corner target sensor (not shown) such as a proximity switch. Each time that a corner of the load approaches the corner target sensor, the corner target sensor senses the corner target associated with that corner of the load. The programmable controls may adjust the speed of the rotational drive via a clutch or transmission (not shown), to adjust the packaging material supply rate as the corner approaches. This corner lock mechanism or a similar mechanism may be used with any of the stretch wrapping apparatus embodiments disclosed herein.

A corner lock mechanism, such as discussed above, may be easily incorporated into a stretch wrap apparatus using an electronic control to maintain the ratio of the rotational drive to the pre-stretch drive. The use of a corner lock mechanism is another instance when it may be desirable to vary the ratio while continuing to proportionally control the drives. In such an embodiment, proximity switches would be used to "pulse" the pre-stretch drive off for a precise rotation angle as a flag passes the proximity switches. This would be done four times during a revolution of the packaging material dispenser relative to a square or rectangular load, each time immediately prior to the passage of a corner of the load, in order to lock in a higher wrap force at the corners of the load. Appropriate alternative positioning of the flags and proximity switches for other types of means for providing relative rotation may be used. In addition, for other shapes of loads, the corner lock mechanism may be adapted accordingly.

According to another aspect of the present disclosure, the stretch wrapping apparatus 100 may be provided with a belted packaging material clamping and cutting apparatus as disclosed in U.S. Pat. No. 4,761,934, the entire disclosure of which is incorporated herein by reference. As shown in FIGS. 9, 10, and 16-20, a wrapping apparatus 510 is shown for wrapping packaging material 512 around a load 514. The wrapping apparatus may include a non-rotating frame 516 defining a wrapping space. The load 514 may be conveyed by a conveyor 518 into the wrapping space prior to wrapping, and out of the wrapping space subsequent to wrapping. A packaging material dispenser 520 is mounted either directly or indirectly to the non-rotating frame 516. The packaging material dispenser 520 is configured to dispense pre-stretched packaging material onto the load 514. The wrapping apparatus 510 may also include, a means for providing relative rotation between a packaging material dispenser 520 and the load 514. The means for providing relative rotation may include a rotating arm, rotatable turntable, or a rotating ring 522. The wrapping apparatus 510 may also include a means for providing relative movement in the direction of the axis of rotation of the load 514. For example, a vertical drive assembly 524 may be provided to drive the rotating ring 522 vertically about the load 514. The relative rotation between the packaging material dispenser 520 and the load 514, in combination with the relative movement of the packaging material dispenser 520 in the direction of the axis of rotation of the load 514, may serve to wrap packaging material spirally around the load 514 and/or a pallet 515 supporting the load.

In an exemplary embodiment, the film web 512 may include stretch wrap packaging material. However, it should be understood that various other packaging materials such as netting, strapping, banding, or tape may be used as well. As used herein, the terms "packaging material," "web," "film," and "packaging material web" may be used interchangeably.

As shown and embodied in FIGS. 10-20, a clamp means may include a clamping and sealing module 526. The clamping and sealing module 526 may include a clamp assembly 528 having first and second longitudinally extending clamp members 530 and 532, a clamping and sealing support frame 534, and a linear bearing assembly 536. The first longitudinally extending clamp member 530 may include a vacuum bar 538, shown in detail in FIGS. 11, 12, and 15-20. The vacuum bar 538 is operatively connected to a vacuum mechanism 540. The second longitudinally extending clamp member 532 may extend generally parallel to the longitudinal extent of first longitudinally extending clamp member 530. As shown in detail in FIGS. 12-14 and 16-20, the second longitudinally extending clamp member 532 may include a front element 542, cutting device 544, belt assembly 546, guiding mechanism 548, base roller 550, and/or sealing assembly 552. The clamping and sealing support frame 534 may include a first actuation mechanism 554 and a second actuation mechanism 556, configured to selectively extend and retract the first and second longitudinally extending clamp members 530 and 532. Additionally or alternatively, the first and second actuation mechanism 554 and 556 may be mounted onto a portion of the non-rotating frame 516.

Figure 10:
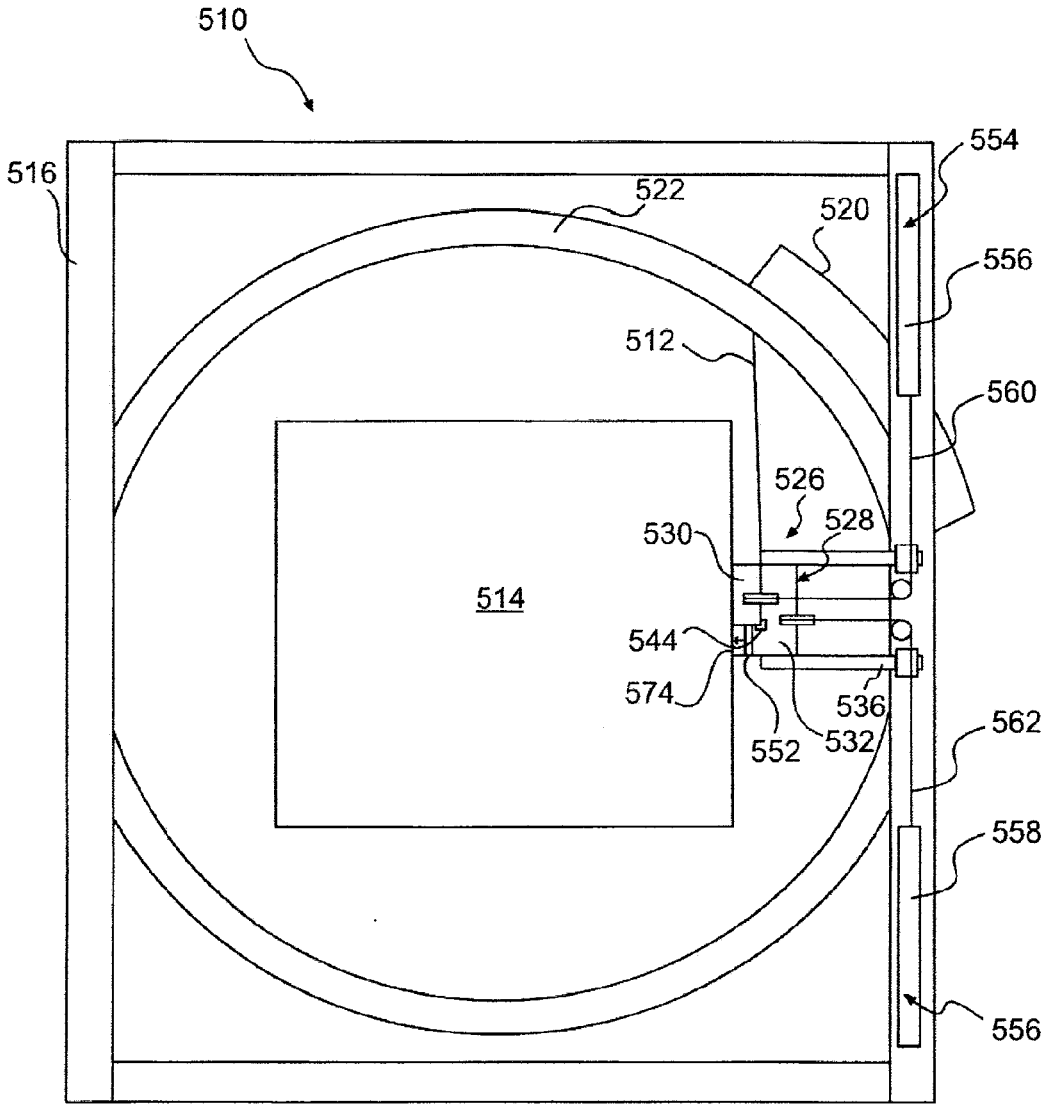
FIG. 10 is a top view of the wrapping apparatus of FIG. 9, incorporating a clamp according to one aspect of the disclosure.
Figure 11:
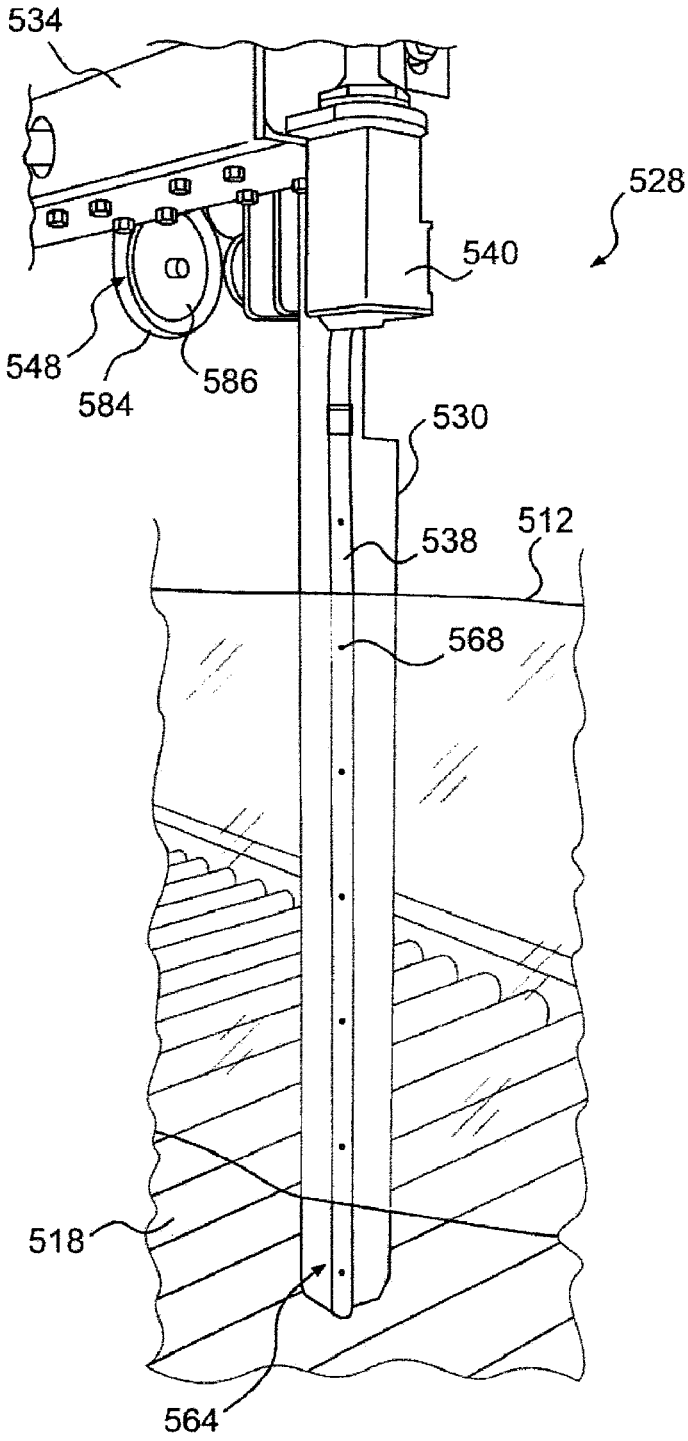
FIG. 11 is a front perspective view of the clamp of FIG. 10, according to an aspect of the disclosure.

The first and second actuation mechanism 554 and 556 may include, for example, rodless cylinders, piston-cylinder arrangements, pulley systems, other motive systems known in the art, and any suitable combinations thereof. The first and second actuation mechanism 554 and 556 may be mounted on the clamping and sealing support frame 534 for movement therewith. Alternatively, as shown in FIG. 10, the first and second actuation mechanism 554 and 556 may include piston cylinders 556 and 558 mounted on the non-rotating frame 516. The piston cylinders 556 and 558 may be operatively coupled to the first and second longitudinally extending clamp members 530 and 532 by cables 560 and 562 or other suitable linkages. During operation, the piston cylinders 556 and 558 may be selectively powered to extend and retract the cables 560 and 562. By extending and retracting the first cable 560, the piston cylinder 556 may support, extend, and retract the first longitudinally extending clamp member 530. A similar relationship may exist between the piston cylinder 558, the cable 562, and the second longitudinally extending clamp member 532. Accordingly, the first and second longitudinally extending clamp members 530 and 532 may be independently extendable and retractable relative to each other, and/or extendable and retractable as a unit.

As shown in FIGS. 11-15, the first longitudinally extending clamp member 530 may include a packaging material engaging surface 564 for contacting the film web 512; and the second longitudinally extending clamp member 532 may include the belt assembly 546 opposed to the packaging material engaging surface 564 for contacting the film web 512. The belt assembly 546 may include an endless belt 566 rotatably mounted on the second longitudinally extending clamp member 532 by one or more bearings or pulleys (not shown). The belt assembly 546 may be movable relative to the remaining portion of the second longitudinally extending clamp member 532, while being fixed relative to the packaging material engaging surface 564, for clamping the film web 512 between the packaging material engaging surface 564 and belt assembly 546. At least one of the packaging material engaging surface 564 and belt assembly 546 may sequentially and continuously clamp the film web 512 across a section of the film web 512.

As shown and embodied in FIGS. 11, 12, and 15-20, the packaging material engaging surface 564 of the first longitudinally extending clamp member 530 may include the vacuum bar or tube 538, which may extend longitudinally along an edge of the first longitudinally extending clamp member 530. The vacuum bar 538 may include one or more holes 568 located at predetermined spaced apart intervals along its length. A lower end of the vacuum bar 538 may be sealed, while an upper end may fluidly communicate with the vacuum mechanism 540. The vacuum mechanism 540 may include a pump and/or vacuum, and may be configured to draw in air through the holes 568 in the vacuum bar 538 to create a suction force at the holes 568. Thus, when the vacuum mechanism 540 is activated, at least a portion of the film web 512 proximate the vacuum bar 538 may be drawn towards and held on the vacuum bar 538 by the suction force at the holes 568. It is contemplated that the vacuum mechanism 540 may be selectively switched on and off by a suitable controller (not shown), and may be directly connected to the vacuum bar 538 or may be connected to the vacuum bar 538 using suitable pipes, hoses, and/or valve devices as would be apparent to one skilled in the art.

Figure 12:
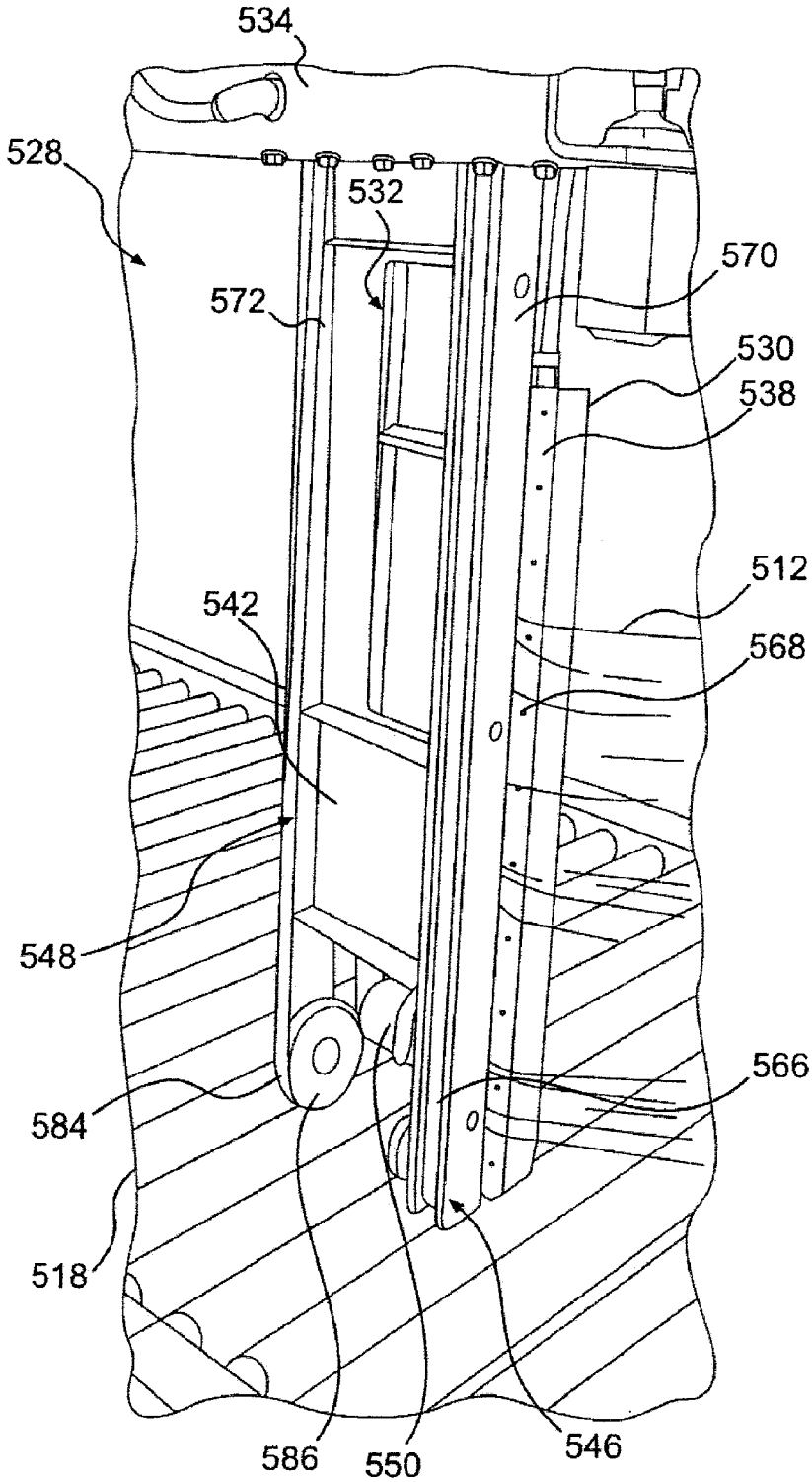
FIG. 12 is a front perspective view of the clamp of FIGS. 10 and 11, according to an aspect of the disclosure.
Figure 13:
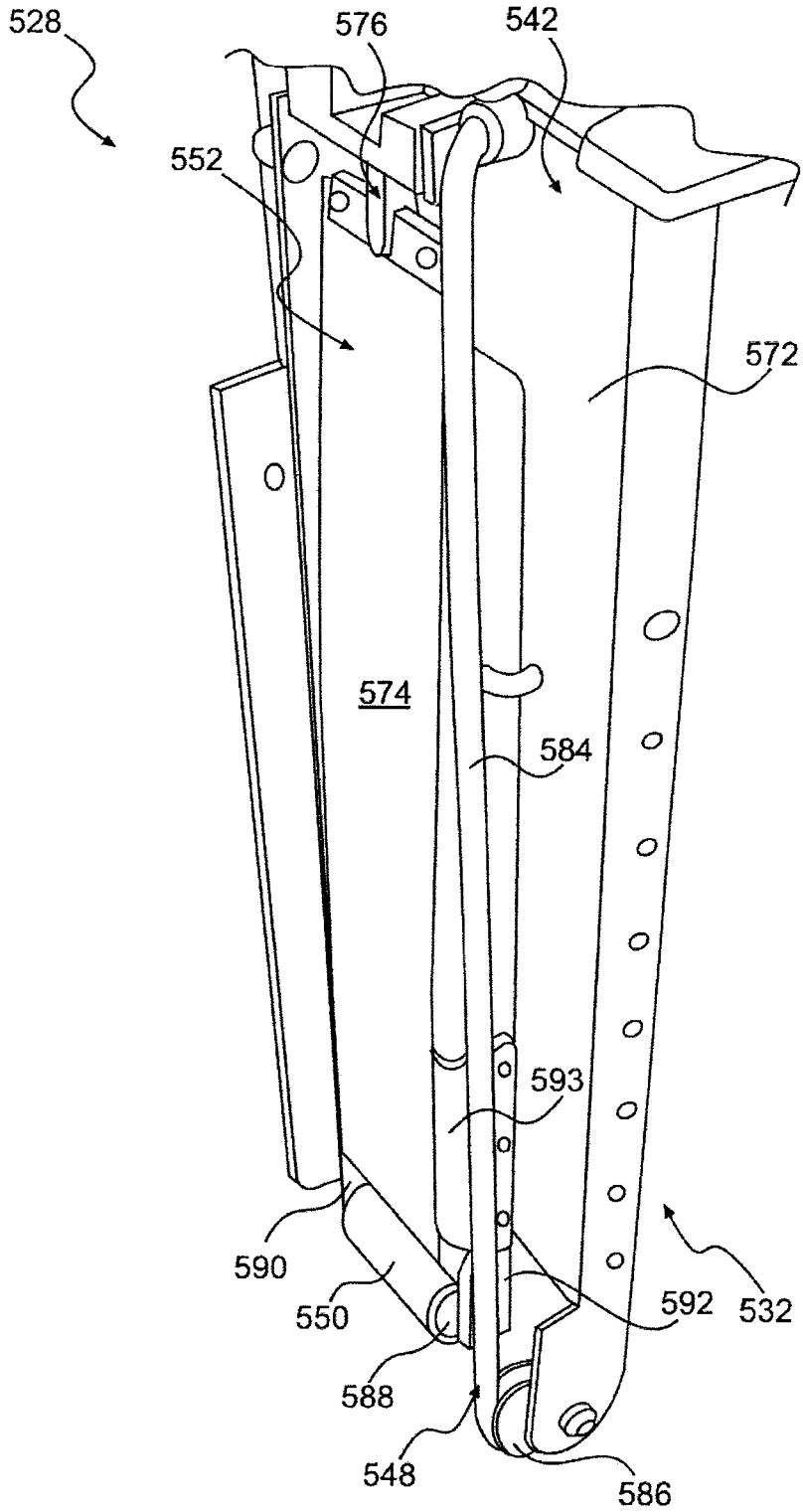
FIG. 13 is a rear perspective view of the clamp of FIGS. 10-12, according to one aspect of the disclosure.
Figure 14:
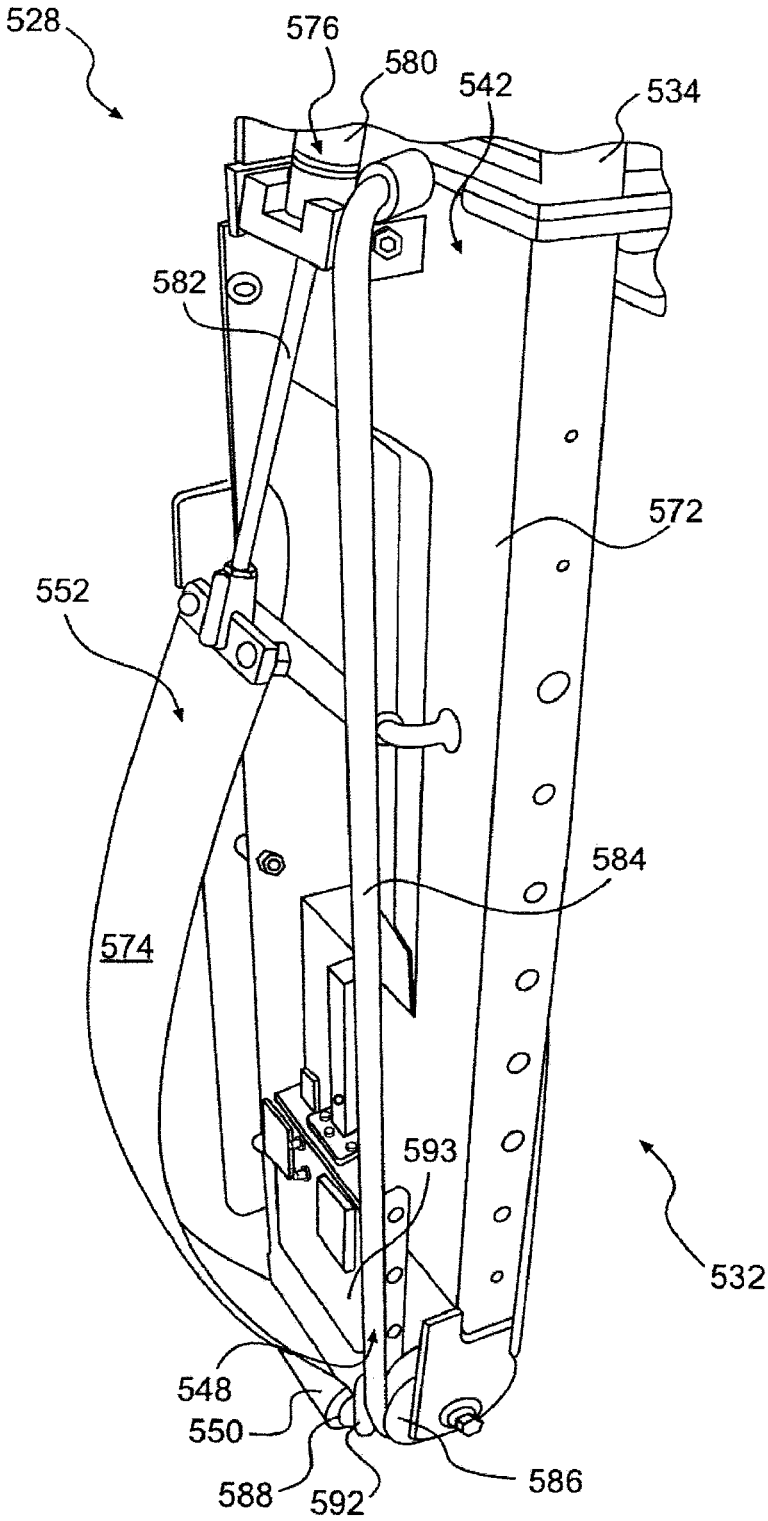
FIG. 14 is a rear perspective view of the clamp of FIGS. 10-13, according to an aspect of the disclosure.

In the embodiment of FIGS. 12-14, the second longitudinally extending clamp member 532 may include the belt assembly 546, front element 542 that may include first and second portions 570 and 572, cutting device 544, guiding mechanism 548, base roller 550, and sealing assembly 552. Both the endless belt 566 and pulley 586 may be mounted on or within the first portion 570 of the second longitudinally extending clamp member 532. The endless belt 566 may be movable along the longitudinal length of the second longitudinally extending clamp member 532 relative to the remaining portions of the second longitudinally extending clamp member 532, while being fixed relative to an opposing surface (i.e., the packaging material engaging surface 564) of the first longitudinally extending clamp member 530. Additionally or alternatively, a portion of the endless belt 566 may be attached to the first longitudinally extending clamp member 530 to allow the endless belt 566 to be fixed relative to the opposing surface at all times.

As shown in FIGS. 10, 12, and 14-20, the first and second longitudinally extending clamp members 530 and 532 may be advanced to engage and clamp the film web 512 between their opposing contact surfaces (i.e., the packaging material engaging surface 564 and the endless belt 566). As such, the packaging material engaging surface 564 and belt assembly 546 on the first and second longitudinally extending clamp members 530 and 532, respectively, sequentially and continuously clamp the film web 512 across a section thereof.

The clamp assembly 528 may also include the cutting device 544. The cutting device 544 may be mounted near the cantilevered end of second longitudinally extending clamp member 532 for cutting the film web 512 as the second longitudinally extending clamp member 532 is extended. The sealing assembly 552 may also be coupled to the second longitudinally extending clamp member 532, and may be configured to seal down the film web 512 to the load 514 subsequent to cutting of the film web 512.

Figure 15:
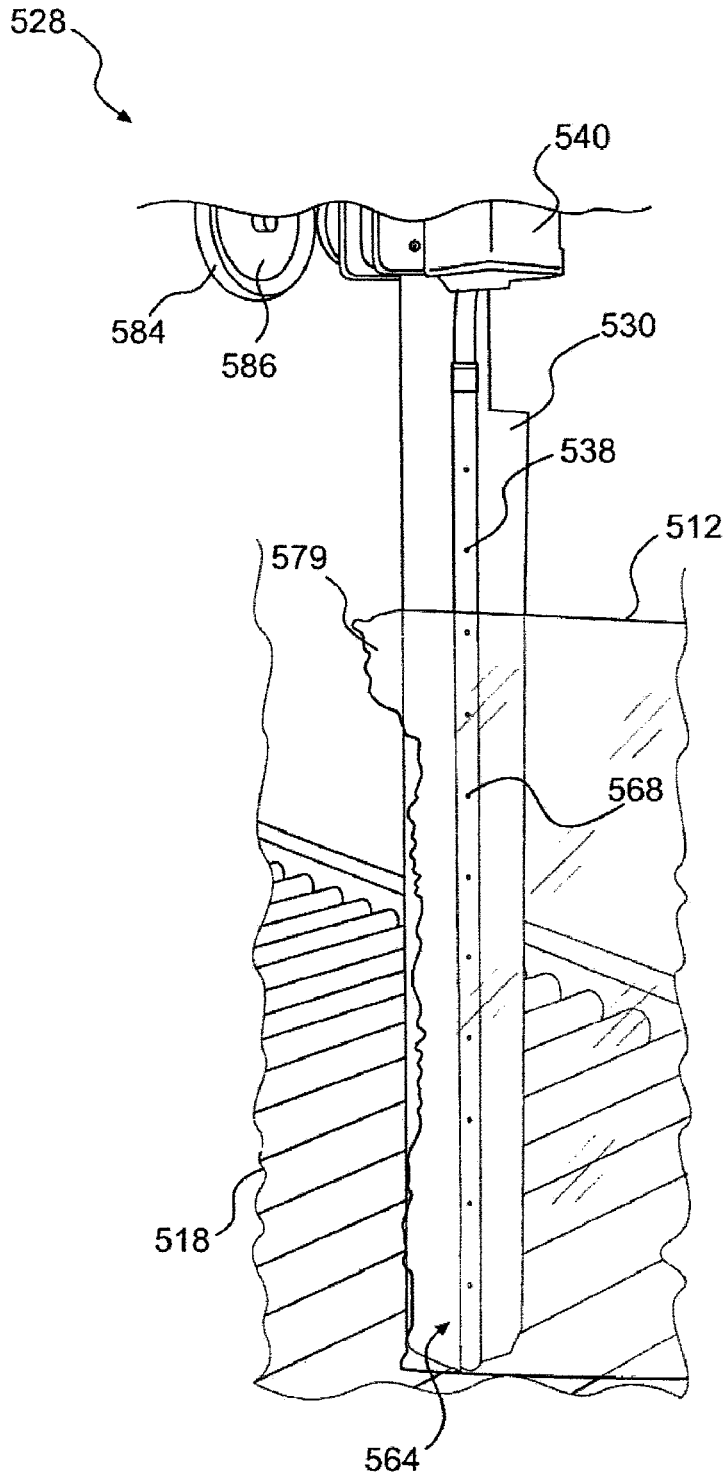
FIG. 15 is a front perspective view of the clamp of FIGS. 10-14, according to one aspect of the disclosure.
Figure 16:
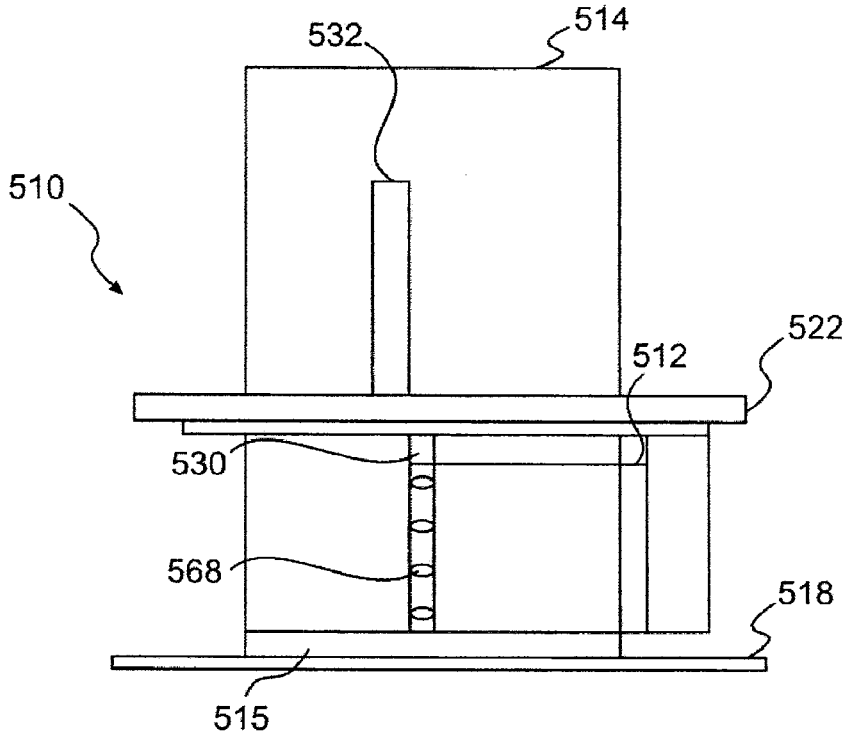
FIG. 16 is a front end section view of the wrapping apparatus of FIGS. 9 and 10, according to an aspect of the disclosure.
Figure 17:
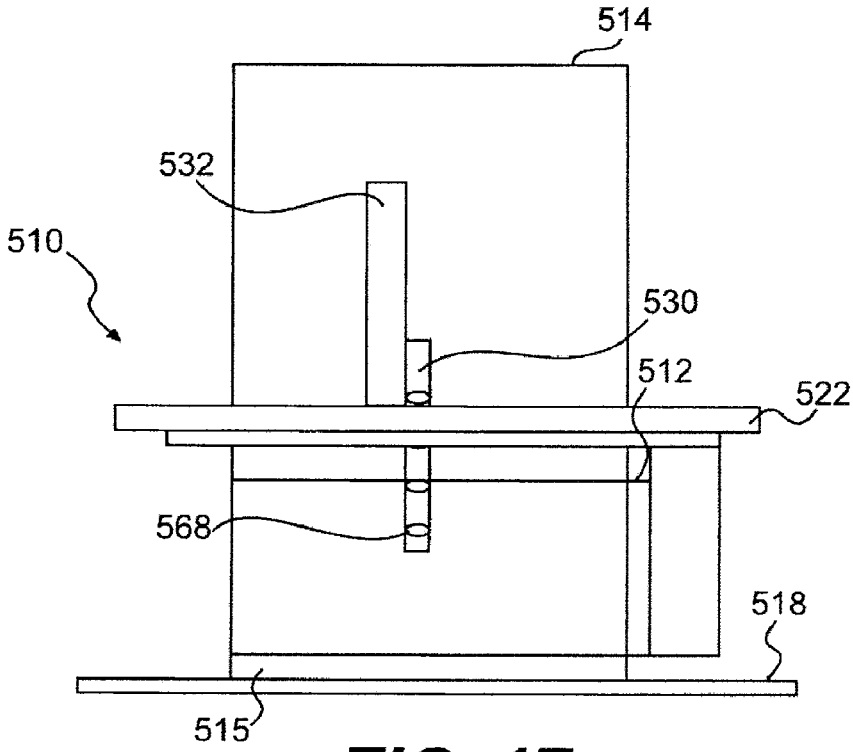
FIG. 17 is a front end section view of the wrapping apparatus of FIGS. 9, 10, and 16 according to an aspect of the disclosure.
Figure 18:
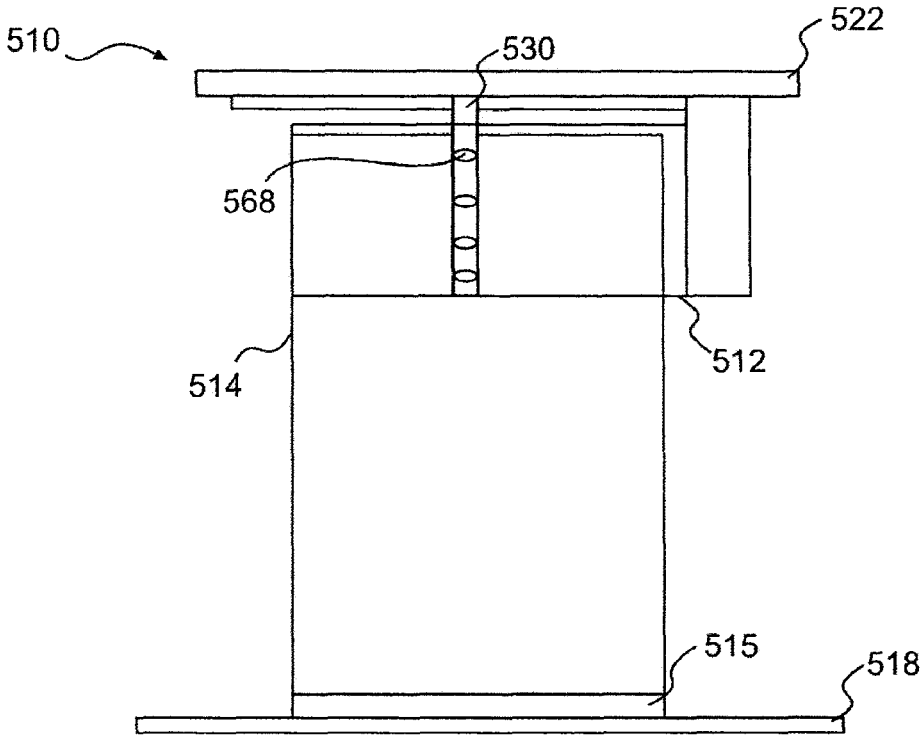
FIG. 18 is a front end section view of the wrapping apparatus of FIGS. 9, 10, 16, and 17 according to an aspect of the disclosure.
Figure 19:
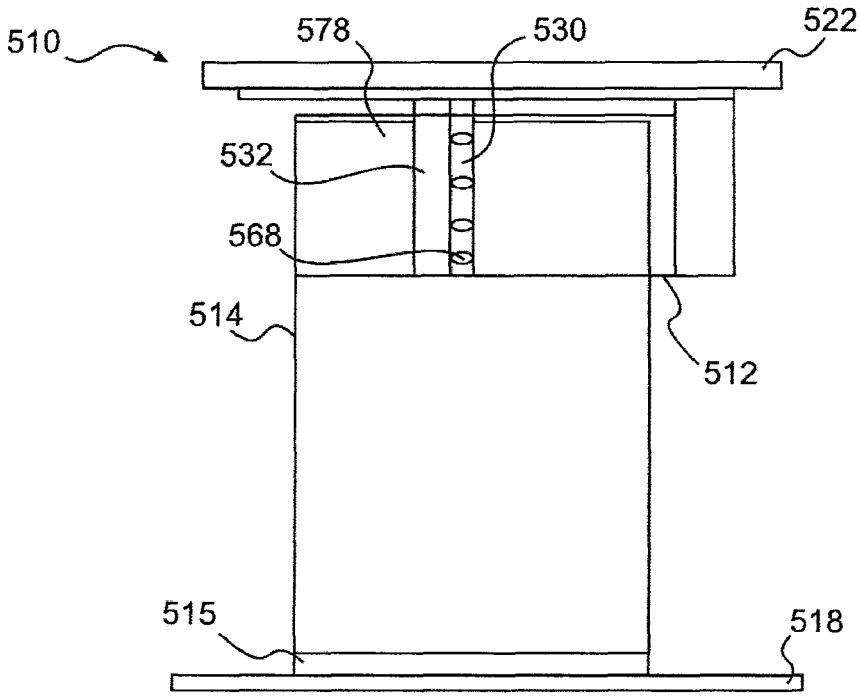
FIG. 19 is a front end section view of the wrapping apparatus of FIGS. 9, 10, and 16-18 according to an aspect of the disclosure.
Figure 20:
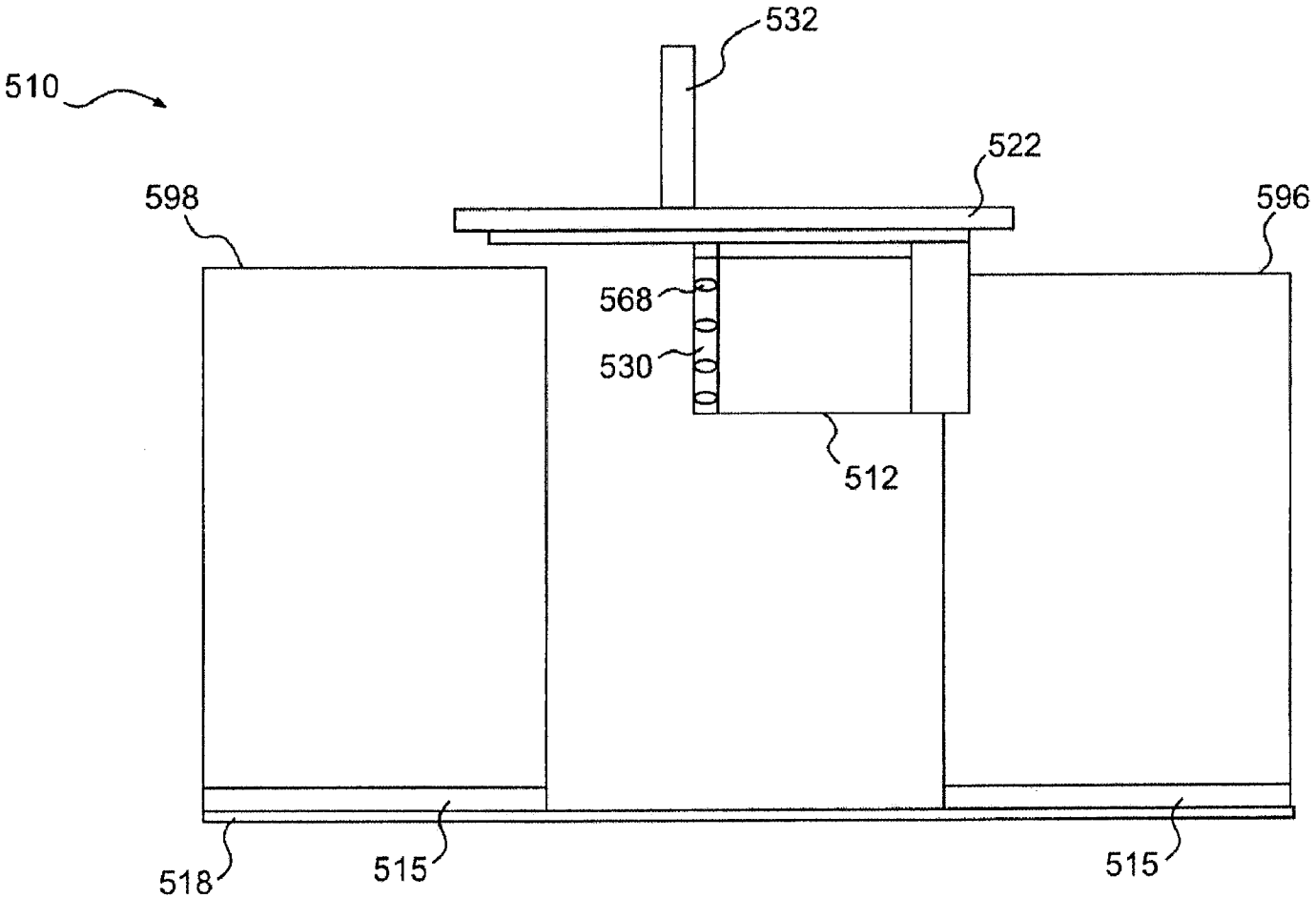
FIG. 20 is a front end section view of the wrapping apparatus of FIGS. 9, 10, and 16-19 according to an aspect of the disclosure.

The cutting device 544 may include, for example, a razor knife blade mounted on and movable with the second longitudinally extending clamp member 532. The blade may have a sharp edge for cutting the film web 512 as the second longitudinally extending clamp member is extended. The cut may be made in the film web 512 at a point between the first and second longitudinally extending clamp members 530 and 532. Additionally or alternatively, it is contemplated that the cutting device 544 may include a hot wire extending along the length of at least one of the first and second longitudinally extending clamp members 530 and 532. In such an embodiment, the hot wire may be heated for cutting the film web 512. As shown in FIGS. 10, 12, and 19, after the cutting step, the film web 512 may remain clamped between the first and second longitudinally extending clamp members 530 and 532. Additionally or alternatively, the film web 512 may be held on the first longitudinally extending clamp member 530 by the suction force created by the vacuum mechanism 540, as depicted in FIGS. 15, 16, and 20.

In accordance with another aspect of the present disclosure, the sealing assembly 552 may be provided to assist in sealing down the film web 512 onto the load 514 after the film web 512 has been cut. The sealing assembly 552 may be operatively coupled to the second longitudinally extending clamp member 532. As shown and embodied in FIGS. 10, 12-14, and 16-20, the sealing assembly 552 may include a pressure strip 574 and a seal actuation mechanism 576, configured for sealing down a trailing edge portion 578 of the film web 512 extending between the load 514 (load not shown in FIGS. 11-15) and the first and second longitudinally extending clamp members 530 and 532. As a result, the trailing edge 578 of the film web 512 may be sealed down into an adhered state to another layer of film which has already been wrapped on the load 514. Sealing down may occur during or after extension of the second longitudinally extending clamp member 532 so the clamping, cutting, and sealing down may all occur in one or more smooth operations. The location, structure, and operation of the pressure strip 574 and seal actuation mechanism 576 will be described in further detail below.

The pressure strip 574 may include a substantially flat metallic strip configured to flex or bend under longitudinal loading. As shown in FIGS. 10, 13, and 14, the pressure strip 574 may include a first end, fixed to the second longitudinally extending clamp member 532, and a second end, fixed to at least a portion of the seal actuation mechanism 576. Upon actuation of the seal actuation mechanism 576 to an extended position, the pressure strip 574 may bend or flex outwardly toward the load 514 to seal down the trailing edge 578 of the film web 512. The flexed orientation of the pressure strip 574 is shown in FIGS. 10 and 14. When the actuation mechanism 576 is retracted, the pressure strip 574 may return to a rest, or unflexed position, depicted in FIG. 13. It is also contemplated that the pressure strip 574 may have stored spring energy while it is flexed. That stored energy may urge the pressure strip 574 and/or seal actuation mechanism 576 back to its rest position. While the use of a substantially flat metallic strip has been disclosed, it should be understood that the pressure strip 574 may have another shape, thickness, and/or geometry, and may be made of another suitable material, that may allow for the sealing down function to be achieved.

The seal actuation mechanism 576 may include a hydraulic, pneumatic, or solenoid actuator within or operatively connected to a housing 580 mounted on the second longitudinally extending clamp member 532 or the clamping and sealing support frame 534. At least a portion of one end of an actuator arm 582 may be movably received within the housing 580, and another end of the actuator arm 582 may be located outside of the housing 580 and may be coupled to the pressure strip 574. When actuated, the seal actuation mechanism 576 may drive the actuator arm 582 to extend outwardly from the housing 580, thus causing the pressure strip 574 to flex outwardly toward the load 514. When flexing of the pressure strip 574 is not desirable, the seal actuation mechanism 576 may be actuated to retract the actuator arm 582, or the actuator arm 582 may retract under the force of a biasing mechanism (not shown) and/or by a return force provided by the spring energy stored in the flexed pressure strip 574.

The guiding mechanism 548 may be mounted on the second longitudinally extending clamp member 532, and may include, for example, a guiding belt 584 and a pulley 586. As the second longitudinally extending clamp member 532 is lowered, the guiding belt 584 may engage at least a portion of the film web 512 that extends between the load 514 and the packaging material engaging surface 564 of the first longitudinally extending clamp member 530. This engagement may help guide the portion of the film web 512 toward an inside face of the second longitudinally extending clamp member 532 that faces the wrapped load 596. The guiding belt 584 may be movable along the longitudinal length of the second longitudinally extending clamp member 532, while being fixed relative to the portion of the film web 512 engaged by the guiding belt 584. This arrangement may assist in ensuring that the film web 512 may be guided to a proper position for sealing down after cutting, while preventing stretching and/or tearing the film web 512 unnecessarily.

The guiding mechanism 548 may also include a base roller 550. The base roller 550 may include a cylindrical roller, which may be coated or uncoated, and may be rotatably mounted on a roller axis 588. The roller axis 588 may be carried between a first arm 590 and a second arm 592 of a roller frame 593. As shown in FIGS. 12-14, the roller frame 593 may be movably mounted onto the second longitudinally extending clamp member 532, and may be configured to slide or otherwise move vertically thereon between a retracted position, shown in FIG. 13, and an extended position, shown in FIG. 14. As the second longitudinally extending clamp member 532 is lowered, the roller frame 593 may be in its retracted position, with the base roller 550 pressing the film web 512 towards and/or against the load 514. The downward motion of the second longitudinally extending clamp member 532 may also carry the base roller 550 downward, thus allowing the base roller 550 to roll across the width of the film web 512 to press the film web 512 against the load 514 and/or the layers of film wrapped thereon. As the second longitudinally extending clamp member 532 nears its lowered position, the roller frame 593 may be actuated by an actuator (not shown) to move to its extended position of FIG. 14, to help ensure that the base roller 550 may engage substantially the entire width of the film web 512. The engagement between the base roller 550 and the film web 512 may serve to maintain the film web 512 in a flat position as it is being cut, which may allow the pressure strip 574 to better seal down the trailing edge portion 578 after cutting.

The clamping and sealing support frame 534, shown in FIGS. 10-12 and 14 may support at least the first and second longitudinally extending clamp members 530 and 532. The clamping and sealing support frame 534 may be supported on the non-rotating frame 516 by the linear bearing assembly 536, which may be fixed to the non-rotating frame 516. The clamping and sealing support frame 534 may travel towards and away from the load 514 along linear bearing assembly 536, to selectively move the first and second longitudinally extending clamp members 530 and 532 towards and away from load 514.

Figure 9:
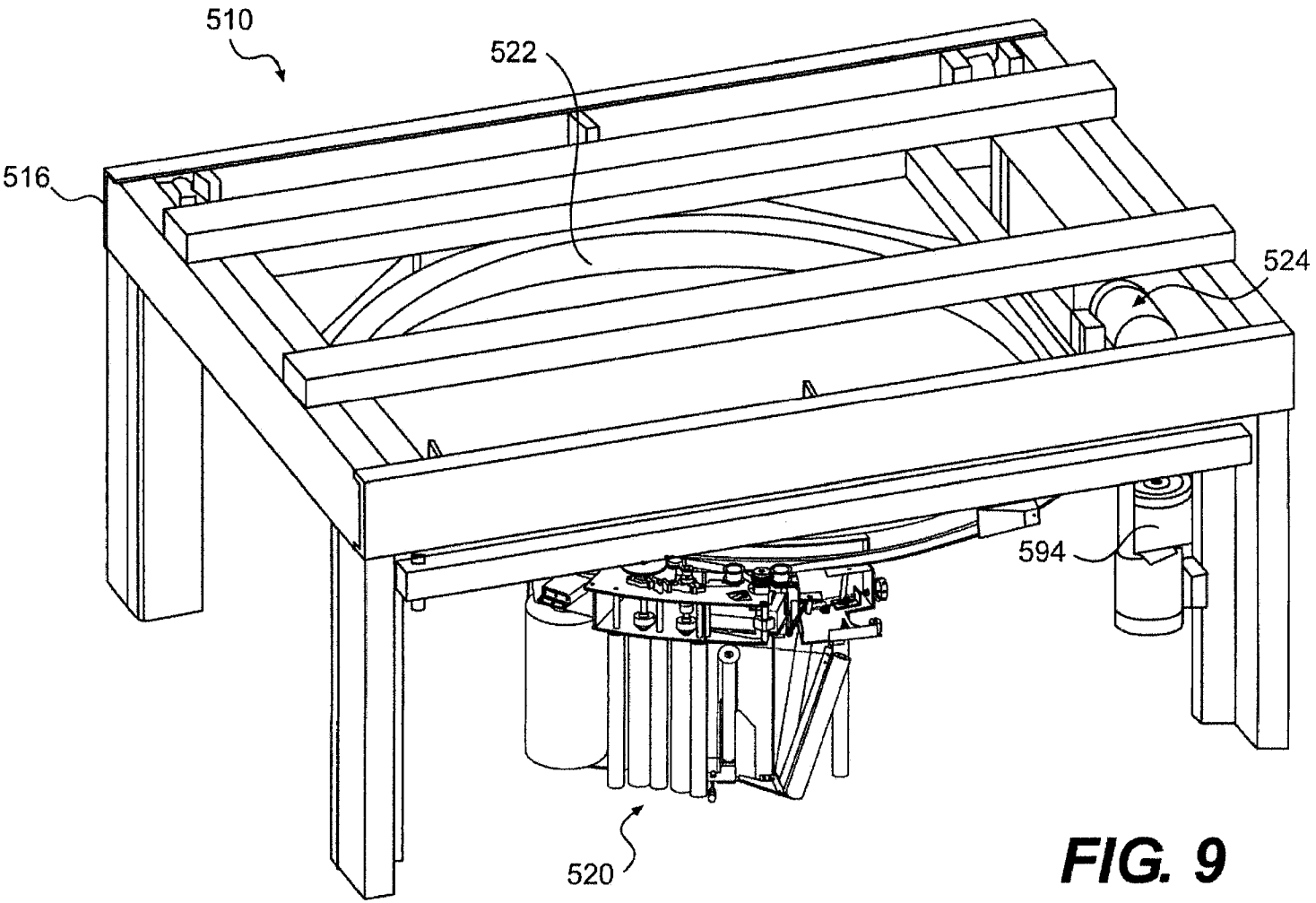
FIG. 9 is an isometric view of a wrapping apparatus according to an alternative aspect of the disclosure.

As shown and embodied in FIGS. 16-20, the stretch wrapping apparatus 510 includes a packaging material dispenser 520. The packaging material dispenser 520 may include at least a roll carriage for supporting a roll of film, a pre-stretch assembly for pre-stretching the film web 512. The means for rotating the load 514 relative to the packaging material dispenser 520 to wrap the load 514 may include the rotating ring 522, mounted on the non-rotating frame 516, as shown in FIGS. 9 and 10. The rotating ring may be rotatably driven by a motor 594 (shown in FIG. 9) in a counterclockwise direction. Although the packaging material dispenser 520 may be fixed relative to the ground and the load 514 may be rotated relative to the ground, for example on a rotating arm or rotatable turntable wrapping apparatus, it is preferable that the load 514 be fixed relative to the ground and that the film dispenser 520 move relative to the ground while revolving around the load 514, such as on the rotating ring stretch wrapping apparatus 510.

A means for conveying the load 514 along a direction parallel to the plane defined by the path of the film dispenser 520 during wrapping may also be included. As shown and embodied in FIGS. 16-20, the means for conveying load 514 may include the conveyor 518. The conveyor 518 may be a conveyor belt having either powered or unpowered rollers.

The step of extending the first and second longitudinally extending clamp members 530 and 532 may include extending them along a direction which is oblique to the plane defined by the path of the packaging material dispenser 520 during wrapping of the load 514. As shown and embodied in FIGS. 16-20, the first and second longitudinally extending clamp members 530 and 532 may be extended in a direction which is oblique to the path of packaging material dispenser 520 as it travels around the rotating ring 522.

In further accordance with the purposes of the disclosure, there is provided a method of wrapping the load 514 with the film web 512. The method may include positioning the load 514 in wrapping position. The first longitudinally extending clamp member 530 may be in the extended position and holding a leading end portion 579 of the film web 512 using suction force from the vacuum bar 538. The first longitudinally extending clamp member 530 is then moved toward the load 514. Relative rotation may be provided between the load 514 and the packaging material dispenser 520 to wrap film 512 on the load 514. When one revolution nears completion or has been completed, the first longitudinally extending clamp member 530 may be raised out of the film path. For example, the first longitudinally extending clamp member 530 may be raised after being overwrapped by the film web 512. Alternatively, the first longitudinally extending clamp member 530 may be raised just prior to being overwrapped by the film web 512. The step of raising the first longitudinally extending clamp member 530 may include turning off the vacuum mechanism 540 to release the leading end portion 579 of the film web 512 from the vacuum bar 538. Once the first longitudinally extending clamp member 530 has been raised, the clamping and sealing support frame 534 may be moved on the linear bearing assembly 536 away from the load 514. Removing the first longitudinally extending clamp member 530 allows the film web 512 to snap back towards the load 514.

The packaging material dispenser 520 may continue to dispense film to the load 514 in a spiral fashion. Approaching the end of the wrap cycle, the first longitudinally extending clamp member 530 may be extended along its longitudinal direction into the wrapping path of the film web 512. The extended first longitudinally extending clamp member 530 may be moved toward the wrapped load 596 by moving the clamping and sealing support frame 534 along the linear bearing assembly 536 in the direction of the load 514. The unextended second longitudinally extending clamp member 532 will also be carried toward the load 514 as the clamping and sealing support frame 534 moves toward the load 514. At least one layer of the film web 512 may be passed over the first longitudinally extending clamp member 530. The vacuum mechanism 540 may be turned on to generate a suction force at the holes 568 of the vacuum bar 538, helping to hold the overwrapped layer of film on the first longitudinally extending clamp member 530.

The second longitudinally extending clamp member 532 may extend in the longitudinal direction in a direction parallel to the first longitudinally extending clamp member 530 to clamp and cut a portion of the film web 512. As the second longitudinally extending clamp member 532 is extended, the guiding belt 584 will guide the film web 512 toward the face of the second longitudinally extending clamp member 532 facing the load 514, such that the second longitudinally extending clamp member 532 is on a side of the film path opposite the load 514. The base roller 550 will engage the film web 512 to help maintain the film web 512 in a relatively flat position as the film web 512 is cut. Maintaining the film web 512 in the relatively flat position helps to ensure that sealing of the film web 512 to the load 514 is effective. As the second longitudinally extending clamp member 532 reaches the extended position, the pressure strip 574 is actuated into the flexed state to seal the trailing end portion 578 of the film web 512 onto the film layers surrounding the wrapped load 596.

Alternatively, the first longitudinally extending clamp member 530 and the second longitudinally extending clamp member 532 may both be extended to clamp the film web 512 without cutting the film web 512 before the clamping and sealing support frame 534 is moved toward the direction of the load 514. In such an embodiment of the method, the first and second longitudinally extending clamp members 530 and 532 may move together toward the load 514 with the film web 512 clamped between them. At or near the surface of the wrapped load 596, the cutting device 544, such as, for example, a hot wire, may be energized to cut the film web 512, and the pressure strip 574 may be actuated into the flexed state to seal the trailing end portion 578 of the film web 512 to the layers of film on the wrapped surface of the load 514.

After the film web 512 has been cut, and the trailing end portion 578 of the film web has been sealed to the film layers on the surface of the wrapped load 596, the clamping and sealing support frame 534 may travel along the linear bearing assembly 536 in a direction away from the wrapped load 596, bringing the extended first and second longitudinally extending clamp members 530 and 532 away from the wrapped load 596. During travel away from the wrapped load 596, both the first and second longitudinally extending clamp members 530 and 532 may remain extended and in clamped configuration to help keep the leading end portion 579 of the film web 512 in place. Alternatively, the second longitudinally extending clamp member 532 may be retracted, and the first longitudinally extending clamp member 530 may hold the film web 512 in place using its suction ability. In either case, moving the first and second longitudinally extending clamp members 530 and 532 gets them out of the way of the wrapped load 596 as the wrapped load 596 is conveyed out of the wrapping area by the conveyor 518. An unwrapped load 598 may then be conveyed into the wrapping area, and the method may repeat for another wrap cycle.

Although disclosed herein as two separate wrapping apparatuses 100 and 510, portions of each apparatus may be practiced with portions of the other apparatus. Similarly, portions of each method disclosed for a specific apparatus may be practiced with portions of other methods disclosed herein.

Other embodiments of the disclosure will be apparent to those skilled in the art from consideration of the specification and practice of the features disclosed herein. It is intended that the specification and examples be considered as exemplary only, with a true scope and spirit of the disclosure being indicated by the following claims.

What is claimed is:

1. An apparatus for stretch wrapping a load, comprising:

a packaging material dispenser for dispensing packaging material, the packaging material dispenser including a pre-stretch assembly;

a drive mechanism configured to provide relative rotation between the packaging material dispenser and the load;

a variable mechanical connection operatively coupling the drive mechanism and the pre-stretch assembly, wherein the drive mechanism drives the pre-stretch assembly via the variable mechanical connection; and a sensing element configured to sense at least one of a film break or slack film associated with the packaging material, wherein a setting of the variable mechanical connection is adjusted based at least in part on the sensed film break or slack film.

2. The apparatus of claim 1, further comprising:

a second mechanical connection between the sensing element and the variable mechanical connection, the second mechanical connection facilitating adjustment of the variable mechanical connection by the sensing element.

3. The apparatus of claim 1, wherein the variable mechanical connection includes an input/output ratio control that is continuously variable over a range.

4. The apparatus of claim 1, wherein the sensing element includes a sensing roller.

5. The apparatus of claim 4, wherein the sensing roller is configured to shift the variable mechanical connection into neutral upon sensing a packaging material break.

6. The apparatus of claim 1, wherein the variable mechanical connection includes a hydrostatic transmission.

7. The apparatus of claim 1, further comprising a packaging material drive down roller positioned to continuously engage at least a portion of a width of a length of packaging material in a packaging material path from the dispenser to the load, the packaging material drive down roller being selectively moveable between a vertical position and a tilted packaging material drive down position.

8. The apparatus of claim 7, further comprising at least one roping element.

9. The apparatus of claim 1, further comprising a packaging material cutting and sealing assembly.

10. The apparatus of claim 1, wherein the sensing element is configured to selectively adjust the setting of the variable mechanical connection.

11. The apparatus of claim 1, wherein the sensing element is configured to automatically adjust the setting of the variable mechanical connection.

12. The apparatus of claim 1, wherein the sensing element is configured to respond to a change in tension in the pre-stretched packaging material by moving from a first position to a second position.

13. The apparatus of claim 1, wherein the packaging material dispenser is mounted on a rotatable ring.

14. The apparatus of claim 13, further including a fixed support structure, the variable mechanical connection including a drive element supported by the fixed support structure.

15. The apparatus of claim 14, wherein the pre-stretch assembly is operatively coupled to the drive element.

16. The apparatus of claim 1, wherein:

the variable mechanical connection implements a ratio of relative rotation speed to pre-stretch speed during at least a primary portion of a wrapping cycle; and the setting of the variable mechanical connection is adjusted in response to a change in the sensed film break or slack film.

17. The apparatus of claim 16, wherein the variable mechanical connection includes an input/output ratio control.

18. The apparatus of claim 16, wherein the ratio is set such that the pre-stretch assembly dispenses a substantially constant length of pre-stretched packaging material for at least a portion of a relative revolution between the packaging material dispenser and the load.

19. The apparatus of claim 16, wherein the variable mechanical connection is configured to maintain a ratio of relative rotation speed to pre-stretch speed during the entire wrapping cycle.

20. The apparatus of claim 16, wherein the variable mechanical connection includes an input driven by the drive mechanism, and an output operatively coupled to the pre-stretch assembly.

21. The apparatus of claim 20, wherein the sensing element is configured to adjust the setting of the variable mechanical connection by adjusting power transmission between the input and the output.

22. The apparatus of claim 16, wherein the setting is adjustable to modify the ratio of relative rotation speed to pre-stretch speed.

23. An apparatus for stretch wrapping a load, comprising:

a packaging material dispenser for dispensing packaging material, the packaging material dispenser including at least one packaging material dispensing roller;

a drive mechanism configured to provide relative rotation between the packaging material dispenser and the load;

a variable mechanical connection operatively coupling the drive mechanism and the packaging material dispensing roller, the variable mechanical connection being configured to implement a ratio of relative rotation speed to packaging material dispensing roller speed, an output of the variable mechanical connection driving the packaging material dispensing roller to dispense a selected length of packaging material for at least a portion of a relative revolution between the packaging material dispenser and the load; and a sensing element configured to sense at least one of a film break or slack film associated with the packaging material, a setting of the variable mechanical connection being adjustable based at least in part on the sensed film break or slack film.

24. The apparatus of claim 23, further comprising:

a second mechanical connection between the sensing element and the variable mechanical connection, the second mechanical connection facilitating adjustment of the variable mechanical connection by the sensing element.

25. The apparatus of claim 23, wherein the at least one packaging material dispensing roller includes an upstream packaging material dispensing roller and a downstream packaging material dispensing roller.

26. The apparatus of claim 25, further comprising a final roller positioned a distance from the downstream packaging material dispensing roller, wherein a length of packaging material extending between the downstream packaging material dispensing roller and the final roller is at least thirteen inches.

27. The apparatus of claim 23, wherein the sensing element includes a sensing roller.

28. The apparatus of claim 23, wherein the setting is adjustable to modify the ratio of relative rotation speed to packaging material dispenser roller speed.

29. The apparatus of claim 23, wherein the variable mechanical connection includes an input.

30. The apparatus of claim 29, further including a drive belt coupled to the input, wherein the drive belt is configured to convert relative rotation provided by the drive mechanism into rotation of the input.

31. The apparatus of claim 23, wherein the variable mechanical connection includes a hydrostatic transmission.

32. An apparatus for stretch wrapping a load, comprising:

a packaging material dispenser for dispensing packaging material, the packaging material dispenser including at least one packaging material dispensing roller;

a drive mechanism configured to provide relative rotation between the packaging material dispenser and the load;

a variable mechanical connection operatively coupling the drive mechanism to the at least one packaging material dispensing roller, the variable mechanical connection being configured to set a ratio of relative rotation speed to packaging material dispensing roller speed, the variable mechanical connection including an input operatively coupled to the drive mechanism to receive power from the drive mechanism, and an output operatively coupled to the at least one packaging material dispensing roller, the output being configured to receive power from the input to drive the packaging material dispensing roller to dispense a selected length of packaging material for at least a portion of a relative revolution between the packaging material dispenser and the load; and a sensing element configured to sense at least one of a film break or slack film associated with the pre-stretched packaging material, a setting of the variable mechanical connection being adjustable based at least in part on a change in the sensed film break or slack film.

33. The apparatus of claim 32, wherein the sensing element includes a sensing roller configured to gauge slack in the packaging material and selectively adjust an input/output ratio of the variable mechanical connection based on the determination.

34. The apparatus of claim 33, wherein the ratio can be adjusted progressively between a maximum value and zero.

35. The apparatus of claim 32, wherein the sensing element is configured to adjust the setting to modify the ratio of relative rotation speed to packaging material dispenser roller speed.

36. The apparatus of claim 32, wherein the variable mechanical connection includes a hydrostatic transmission.

37. A method for stretch wrapping a load, comprising:

dispensing packaging material with a packaging material dispenser;

providing relative rotation between the packaging material dispenser and the load with a drive mechanism;

setting a ratio of relative rotational speed to packaging material dispensing speed with a variable mechanical connection operatively coupling the drive mechanism to the packaging material dispenser;

sensing at least one of a film break or slack film associated with the dispensed packaging material; and adjusting a setting of the variable mechanical connection based at least in part on the sensed film break or slack film.

38. The method of claim 37, further comprising:

continuously engaging the packaging material in a packaging material path between the dispenser and the load with at least one packaging material drive down roller; and selectively driving down a portion of the packaging material in the packaging material path with the at least one packaging material drive down roller.

39. The method of claim 38, further comprising roping a portion of the packaging material into a cable.

40. The method of claim 37, further including driving the packaging material dispenser to dispense a chosen length of packaging material during at least a portion of a relative revolution between the packaging material dispenser and the load.

41. The method of claim 37, wherein setting a ratio of relative rotational speed to packaging material dispensing speed includes determining a girth of the load, and setting the ratio based at least in part on the girth.

* * * * *